US010174655B2

(12) United States Patent
Kikuchi et al.

(10) Patent No.: US 10,174,655 B2
(45) Date of Patent: Jan. 8, 2019

(54) SILENCER

(71) Applicant: Kobe Steel, Ltd., Hyogo (JP)

(72) Inventors: Masahiro Kikuchi, Kobe (JP); Kazuki Tsugihashi, Kobe (JP); Yosuke Fukushima, Hyogo (JP); Kazuya Hirata, Hyogo (JP); Suguru Kiuchi, Hyogo (JP)

(73) Assignee: Kobe Steel, Ltd., Hyogo (JP)

( * ) Notice: Subject to any disclaimer, the term of this patent is extended or adjusted under 35 U.S.C. 154(b) by 69 days.

(21) Appl. No.: 15/313,903

(22) PCT Filed: May 19, 2015

(86) PCT No.: PCT/JP2015/064376
§ 371 (c)(1),
(2) Date: Nov. 23, 2016

(87) PCT Pub. No.: WO2015/182443
PCT Pub. Date: Dec. 3, 2015

(65) Prior Publication Data

US 2017/0191390 A1 Jul. 6, 2017

(30) Foreign Application Priority Data

May 30, 2014 (JP) ..... 2014-113369
Apr. 27, 2015 (JP) ..... 2015-090708

(51) Int. Cl.
*F01N 1/16* (2006.01)
*F01N 1/08* (2006.01)
(Continued)

(52) U.S. Cl.
CPC ..... *F01N 1/163* (2013.01); *F01N 1/02* (2013.01); *F01N 1/04* (2013.01); *F01N 1/08* (2013.01);
(Continued)

(58) Field of Classification Search
CPC ..... F01N 1/02; F01N 1/04; F01N 1/08; F01N 1/089; F01N 1/10; F01N 1/163;
(Continued)

(56) References Cited

U.S. PATENT DOCUMENTS 733,330 A * 7/1903 New ..... F01N 1/165 181/278
1,615,564 A * 1/1927 Beery ..... F01N 1/08 137/601.18
(Continued)

FOREIGN PATENT DOCUMENTS

DE 19520157 A1 * 12/1996 ..... F01N 1/084
EP 1867844 A1 * 12/2007 ..... F01N 1/166
(Continued)

OTHER PUBLICATIONS

International Search Report issued in PCT/JP2015/064376; dated Aug. 18, 2015.
(Continued)

*Primary Examiner* — Edgardo San Martin
(74) *Attorney, Agent, or Firm* — Studebaker & Brackett PC

(57) ABSTRACT

A silencer includes: a housing that has a draw-in portion drawing in fluid, and a plurality of sound attenuating portions arranged in a flowing direction of the fluid; a first partition provided with an intermediate communicating portion communicating the most downstream attenuating portion with the adjacent attenuating portion located adjacent to the most downstream attenuating portion; a valve portion disposed in the most downstream attenuating portion, the valve portion being capable of closing the intermediate communicating portion; a valve holding portion holding the valve portion, the valve holding portion being detachably attached to the housing; and a draw-out portion provided in a portion of the most downstream attenuating portion other
(Continued)

than the valve holding portion, the draw-out portion drawing out the fluid from the most downstream attenuating portion.

16 Claims, 16 Drawing Sheets

(51) Int. Cl.

| | |
|---|---|
| ***F01N 1/02*** | (2006.01) |
| ***F01N 1/04*** | (2006.01) |
| ***F04B 39/00*** | (2006.01) |
| ***F04B 53/00*** | (2006.01) |
| *F01N 1/00* | (2006.01) |

(52) U.S. Cl.
CPC ..... *F01N 1/165* (2013.01); *F01N 1/166* (2013.01); *F04B 39/0033* (2013.01); *F04B 53/002* (2013.01); *F01N 2590/02* (2013.01); *F01N 2590/08* (2013.01)

(58) Field of Classification Search
CPC ..... F01N 1/166; F01N 1/168; F01N 13/08; F04B 39/00; F04B 39/0027; F04B 39/0038; F04B 39/005; F04B 39/0061; F04C 29/00; F04C 29/06; F04C 29/065
See application file for complete search history.

(56) References Cited

U.S. PATENT DOCUMENTS

| | | | | |
|---|---|---|---|---|
| 1,666,005 | A * | 4/1928 | Culp | F01N 1/089 123/41.31 |
| 1,709,426 | A * | 4/1929 | Beery | F01N 1/084 137/527 |
| 2,072,372 | A * | 3/1937 | Riethmiller | F01N 1/166 181/254 |
| 4,903,486 | A * | 2/1990 | Finkle | F01N 1/165 181/236 |
| 5,246,205 | A * | 9/1993 | Gillingham | F01N 1/006 251/334 |
| 5,810,566 | A | 9/1998 | Pauwels | |
| 5,917,161 | A * | 6/1999 | Fuhrmann | F01N 1/166 181/237 |
| 6,983,820 | B2 | 1/2006 | Boast et al. | |
| 7,281,605 | B2 * | 10/2007 | Huff | F01N 1/006 181/250 |
| 7,849,960 | B2 * | 12/2010 | Nicolai | F01N 1/003 181/253 |
| 8,468,813 | B2 * | 6/2013 | Hill | F01N 1/006 60/324 |
| 8,763,384 | B2 * | 7/2014 | Takagaki | F01N 1/02 137/527.6 |
| 2005/0061580 | A1 * | 3/2005 | Wiemeler | F01N 1/165 181/254 |
| 2006/0124384 | A1 | 6/2006 | Tary et al. | |
| 2008/0308348 | A1 * | 12/2008 | Bushell | F01N 1/083 181/254 |

FOREIGN PATENT DOCUMENTS

| | | | |
|---|---|---|---|
| JP | 61-234217 | A | 10/1986 |
| JP | 62-179316 | U | 11/1987 |
| JP | 4-105920 | U | 9/1992 |
| JP | 5-13933 | Y2 | 4/1993 |
| JP | 9-170551 | A | 6/1997 |
| JP | 9-170554 | A | 6/1997 |
| JP | 9-184592 | A | 7/1997 |
| JP | 9-256834 | A | 9/1997 |
| JP | 2001-289167 | A | 10/2001 |
| JP | 2006-144557 | A | 6/2006 |
| TW | 200512372 | A | 4/2005 |
| TW | 200839083 | A | 10/2008 |

OTHER PUBLICATIONS

Written Opinion issued in PCT/JP2015/064376; dated Aug. 18, 2015.
Notification of Transmittal of Translation of the International Preliminary Report on Patentability and Translation of Written Opinion of the International Searching Authority; PCT/JP2015/064376; dated Dec. 15, 2016.
An Office Action issued by Taiwan Patent Office dated Dec. 11, 2017, which corresponds to Taiwanese Patent Application No. 104117159 and is related to U.S. Appl. No. 15/313,903.

* cited by examiner

SILENCER

CROSS-REFERENCE TO RELATED APPLICATIONS

This is a national phase application in the United States of International Patent Application No. PCT/JP2015/064376 with an international filing date of May 19, 2015, which claims priorities of Japanese Patent Applications No. 2014-113369 filed on May 30, 2014 and No. 2015-090708 filed on Apr. 27, 2015 the contents of which are incorporated herein by reference.

TECHNICAL FIELD

The present invention relates to a silencer.

BACKGROUND ART

JP 09-170554 A discloses an acoustic outlet piece for compressor, which includes attenuators symmetrically provided around a path having a uniform diameter.

In the acoustic outlet piece, the attenuator is formed such that the outer circumference gradually increases in the flowing direction to increase the thickness. Therefore, attenuation can be performed in an extremely wide frequency range, in particular, the entire frequency range generated in a compression pulse of a screw-type compressor, that is, in the range of 250 Hz to 6,000 Hz.

However, the path of the acoustic outlet piece linearly extends from an inlet to an outlet and thus, when the flow rate becomes large to increase the inner diameter of the path, or when the whole length is made small in terms of space to decrease the distance between the inlet and the outlet, only an insufficient silencing effect may be acquired in a high frequency range. In some cases, such compact configuration having a small length cannot attenuate sound in a wide frequency range.

JP 04-105920 U discloses a silencer provided with an inlet pipe having a deep bowl-shaped extending portion, an outlet pipe having a deep bowl-shaped extending portion, and an intermediate pipe that couples the bowl-shaped extending portions of the inlet pipe to the outlet pipe.

In the silencer, a shallow bowl-shaped core body having a contracted pipe port at its concave central region is provided at the coupling site of the inlet pipe and the intermediate pipe. A core body, and a valve body including a valve portion that opens/closes the pipe port of the core body on the side of the outlet pipe are provided at the coupling site of the inlet pipe and the intermediate pipe.

However, since the silencer includes the large valve portion having a support point at the coupling site of the inlet pipe and the intermediate pipe, the valve body cannot be readily accessed at maintenance.

SUMMARY OF THE INVENTION

Problems to be Solved by the Invention

An object of the present invention is to attenuate sound in a wide frequency range, and to readily maintain a valve portion for preventing backflow of fluid, with compact configuration.

Means for Solving the Problems

To attain the object, a silencer of the present invention includes: a housing having a draw-in portion drawing in fluid, and a plurality of sound attenuating portions arranged in a flowing direction of the fluid; a first partition provided with an intermediate communicating portion communicating the most downstream attenuating portion with the adjacent attenuating portion located adjacent to the most downstream attenuating portion; a valve portion disposed in the most downstream attenuating portion, the valve portion being capable of closing the intermediate communicating portion; a valve holding portion holding the valve portion, the valve holding portion being detachably attached to the housing; and a draw-out portion provided in a portion of the most downstream attenuating portion other than the valve holding portion, the draw-out portion drawing out the fluid from the most downstream attenuating portion.

With this configuration, since the valve portion is disposed in the most downstream attenuating portion, the silencer can be made compact. By arranging the plurality of attenuating portions in the flowing direction of fluid in the housing, and providing the first partition between the attenuating portions with the intermediate communicating portion, sound waves can be attenuated in a wide frequency range. Therefore, sound in a wide frequency range can be attenuated with compact configuration. The valve holding portion in the housing can hold the valve portion capable of closing the intermediate communicating portion, preventing backflow of fluid. Further, since the valve portion is provided at the valve holding portion detachably attached to the housing, and the draw-out portion is provided at a portion of the housing other than the valve holding portion, the valve portion can be maintained without detaching piping downstream of the draw-out portion. That is, attenuation of sound in a wide frequency range, and simple maintenance of the valve portion for preventing backflow of fluid can be achieved with compact configuration.

Preferably, the silencer includes a biasing member elastically biasing the valve portion so as to close the intermediate communicating portion.

Preferably, in a space formed between the valve portion and the first partition, followed by pressing of flow of the fluid onto the valve portion, a virtual extended area that is an area of a region acquired by extending an inner circumferential face of the intermediate communicating portion to an end face of the valve portion on the side of the first partition is larger than a path sectional area of the draw-in portion. This configuration can prevent an increase in pressure loss in the path, which is caused by providing the valve portion in the most downstream attenuating portion.

Preferably, a path sectional area of the most downstream attenuating portion, and a path sectional area of the adjacent attenuating portion each are larger than a path sectional area of the intermediate communicating portion. With this configuration, the path sectional area can be varied, thereby attenuating sound generated when fluid passes.

Preferably, the plurality of attenuating portions includes a low frequency-side attenuating portion attenuating sound in a lower frequency range, and a high frequency-side attenuating portion attenuating sound in a higher frequency range. With this configuration, sound in a wide frequency range ranging from the lower frequency range to the higher frequency range can be attenuated.

Preferably, the adjacent attenuating portion is the high frequency-side attenuating portion in which a sound absorbing member is disposed, and the first partition is detachably attached to the housing. With this configuration, the sound absorbing member accommodated in the adjacent attenuating portion can be readily maintained by detaching the valve holding portion from the housing and removing the first partition from the housing.

Preferably, the adjacent attenuating portion is the high frequency-side attenuating portion, and the draw-in portion has a bent configuration. With this configuration, since the draw-in portion is bent, the flowing direction of fluid can be changed. That is, sound can be deviated from a direction other than the fluid flowing direction in the high frequency-side attenuating portion, thereby attenuating sound in a high frequency range in the high frequency-side attenuating portion more effectively.

Preferably, the draw-in portion is connected to a discharge port of a compressor body, and the most upstream attenuating portion is disposed so as to be invisible from the discharge port of the compressor body. With this configuration, a substance dropped from the most upstream attenuating portion can be prevented from entering into the compressor body through the discharge port of the compressor body.

Preferably, the most upstream attenuating portion is the low frequency-side attenuating portion, and the draw-in portion is disposed on a side wall of the housing defining the most upstream attenuating portion. This configuration can prevent an increase in the axial dimension of the silencer.

Preferably, the most upstream attenuating portion is provided with a bypass pipe. With this configuration, even when passage of fluid stops to open the valve portion, and the pressure in the most upstream low frequency-side attenuating portion increases, fluid can be drawn out through the bypass pipe. This can prevent the pressure in the low frequency-side attenuating portion from keeping high. The most upstream low frequency-side attenuating portion can be provided with the bypass pipe, to use the attenuating portion as a side branch (resonator). The bypass pipe can be incorporated into the silencer in this manner, reducing the number of components.

The high frequency-side attenuating portion may include: a tubular perforated plate having a plurality of through holes; a rear fluid layer provided between the perforated plate and the housing; and a second partition partitioning the rear fluid layer into a first region and a second region arranged in a flowing direction of the fluid in the perforated plate.

Resonance at the frequency to be attenuated in the high frequency-side attenuating portion can be suppressed by partitioning the rear fluid layer into the first region and the second region with the second partition. The first region and the second region may have different frequencies capable of achieving the attenuating effect.

A gap may be provided between the second partition and a side wall of the housing or the perforated plate.

The first region and the second region may have different effective thicknesses defined as a ratio of a volume of the rear fluid layer to a porous area that is a sum of areas of the through holes. With this configuration, the first region and the second region may have different frequencies to be attenuated.

For example, the second partition may partition the rear fluid layer such that the first region and the second region partially overlap each other (so-called nested configuration).

When the most upstream the attenuating portion is the low frequency-side attenuating portion, and the high frequency-side attenuating portion is adjacently provided downstream of the low frequency-side attenuating portion, the draw-in portion preferably has a bent configuration. In this case, a direction in which fluid is introduced into the low frequency-side attenuating portion in the draw-in portion may be different from a direction in which the fluid flows from the low frequency-side attenuating portion to the high frequency-side attenuating portion. With such configuration, the travelling direction of sound waves may be bent or disturbed to orient the sound waves to the perforated plate, enhancing the sound attenuating effect in the high frequency-side attenuating portion. Since sound waves enters into the high frequency-side attenuating portion immediately after bending or disturbing of the travelling direction, the sound attenuating effect in the high frequency-side attenuating portion can be enhanced more effectively.

Preferably, the attenuating portion adjacently disposed upstream or downstream of the high frequency-side attenuating portion has a length that is a half of a length of the rear fluid layer. With this configuration, sound waves in the frequency range that resonate in the high frequency-side attenuating portion can be reduced before the sound waves enters into the high frequency-side attenuating portion, or the high frequency-side attenuating portion is added. In other words, the effect of reducing sound waves in the attenuating portion adjacently disposed upstream or downstream of the high frequency-side attenuating portion can be supplemented. In particular, the attenuating portion having the length that is a half of the length of the rear fluid layer is adjacently provided upstream of the high frequency-side attenuating portion. With this configuration, since sound waves in the frequency range that resonate in the high frequency-side attenuating portion may be previously attenuated before entering into the high frequency-side attenuating portion, sound waves in the frequency range that resonate in the high frequency-side attenuating portion can be reduced more effectively.

Effect of the Invention

According to the present invention, attenuation of sound in a wide frequency range, and simple maintenance of a valve portion for preventing backflow of fluid can be achieved with compact configuration.

MODE FOR CARRYING OUT THE INVENTION

Embodiments of the present invention will be described below with reference to drawings.

First Embodiment

Figure 1:
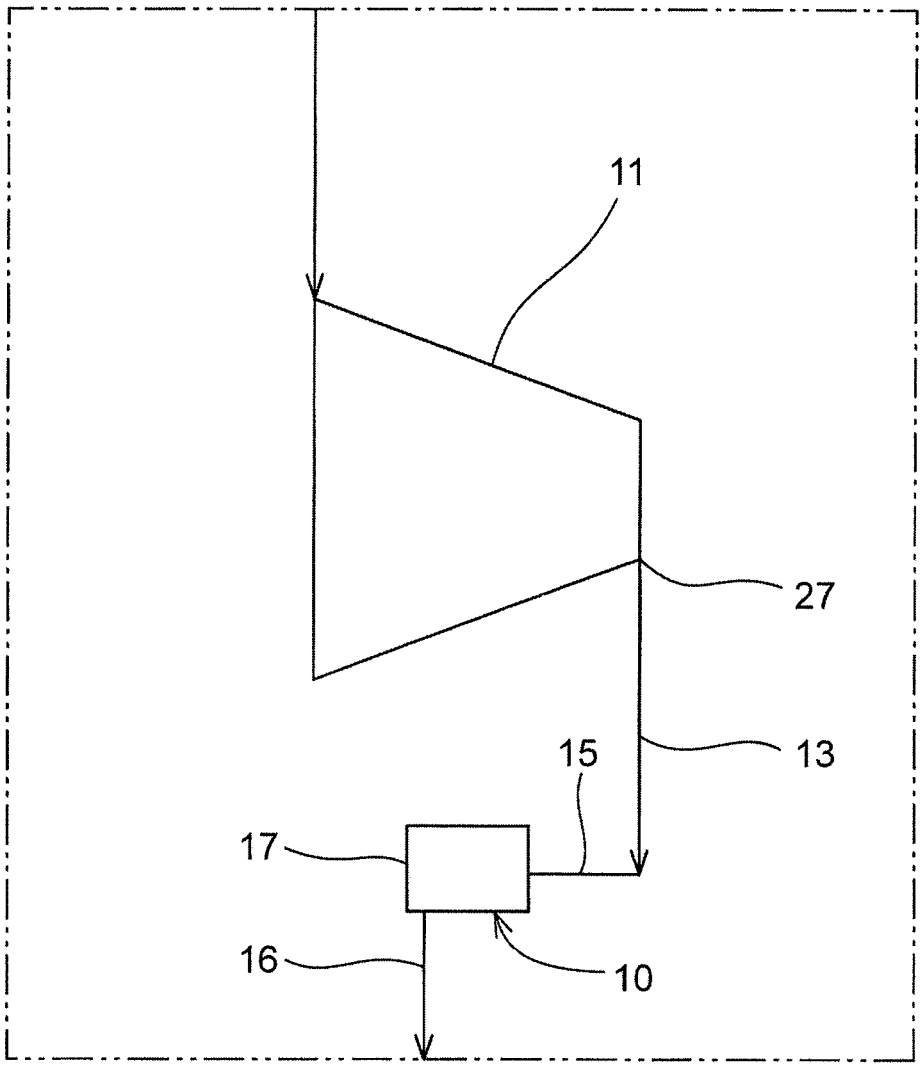
FIG. 1 is a schematic view of a main part of a device adopting a silencer in accordance with a first embodiment of the present invention.

FIG. 1 illustrates a main part of a device (screw compressor) including a silencer in accordance with a first embodiment of the present invention. A silencer 10 is incorporated into a path through which sound waves superimposed on fluid flow is transmitted. In below-mentioned examples, to silence sound generated by passage of compressed air that is fluid, the silencer 10 is disposed in a discharge path 13 of a screw compressor body 11.

Figure 2:
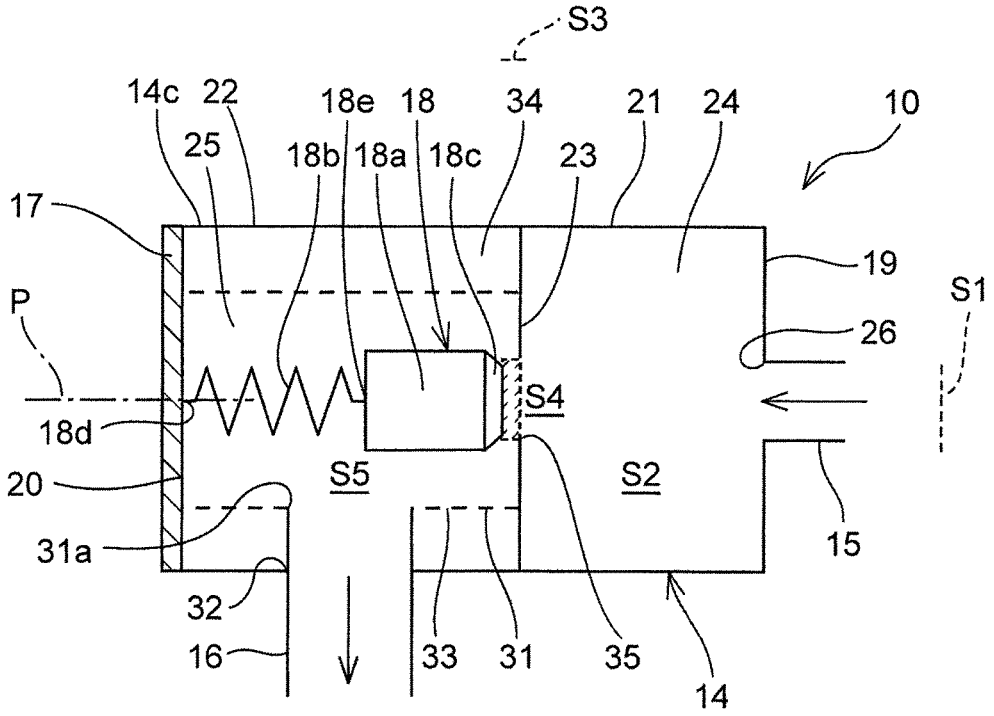
FIG. 2 is a schematic longitudinal-sectional view of the silencer in accordance with the first embodiment of the present invention.

As illustrated in FIG. 2, the silencer 10 includes a silencer body (housing) 14, a draw-in portion 15, a draw-out portion 16, a cover portion (valve holding portion) 17, and a valve portion 18.

The silencer body 14 is cylindrical so as to pass fluid therethrough. The silencer body 14 includes a closed section 19 at one end, and an opening 20 at the other end along an axis P. The closed section 19 is provided with the draw-in portion 15. The cover portion 17 is provided on the opening 20.

The silencer body 14 includes two types of attenuating portions (sound attenuating portions) 21, 22 that are adjacent to each other along the axis P. The two types of attenuating portions 21, 22 are the low frequency-side attenuating portion 21 and the high frequency-side attenuating portion 22. The low frequency-side attenuating portion 21 reduces sound waves in the frequency range of about 500 Hz to 1,000 Hz. The high frequency-side attenuating portion 22 reduces sound waves in the frequency range of about 1,000 Hz to 3,000 Hz. The low frequency-side attenuating portion 21 is disposed on the upstream side (on the side of the closed section 19). The high frequency-side attenuating portion 22 is disposed on the downstream side (on the side of the opening 20). In the present embodiment, since the silencer 10 has the two attenuating portions, the high frequency-side attenuating portion 22 is the most downstream attenuating portion, and the low frequency-side attenuating portion 21 is an adjacent attenuating portion located adjacent to the most downstream attenuating portion, that is, the most upstream attenuating portion. A first partition 23 is provided between the low frequency-side attenuating portion 21 and the high frequency-side attenuating portion 22. The silencer body 14 and the first partition 23 define a low frequency-side processing space 24 of the low frequency-side attenuating portion 21 and a high frequency-side processing space 25 of the high frequency-side attenuating portion 22.

The low frequency-side attenuating portion 21 is an extended chamber having a path sectional area S2 that is larger than a path sectional area 51 of the draw-in portion 15. The low frequency-side attenuating portion 21 attenuates sound in the lower frequency range. The low frequency-side attenuating portion 21 of the silencer body 14 is provided with an inflow port 26. The inflow port 26 is coaxial with the axis P of the silencer body 14. The inflow port 26 is provided with the draw-in portion 15 for drawing fluid into the low frequency-side attenuating portion 21.

The high frequency-side attenuating portion 22 is a sound absorbing chamber including a tubular perforated plate 31 opened at both ends. The high frequency-side attenuating portion 22 attenuates sound in the higher frequency range. The high frequency-side attenuating portion 22 of the silencer body 14 has an outflow port 32 for drawing out fluid. The outflow port 32 is disposed at a position other than the opening 20 (covered with the cover portion 17) that is one axial end of the silencer body 14. In the present embodiment, the outflow port 32 is provided in a side wall of the cylindrical silencer body 14. The outflow port 32 is provided with the draw-out portion 16 for drawing out fluid from the high frequency-side attenuating portion 22. The draw-out portion 16 extends downward from the silencer body 14 in the figure to be orthogonal to the axis P of the silencer body 14. The draw-out portion 16 passes through the outflow port 32, and penetrates the silencer body 14. One end of the draw-out portion 16 is coupled to a coupling hole 31*a* of the below-mentioned perforated plate 31.

The perforated plate 31 is made of metal such as iron and aluminum, or a synthetic resin. The perforated plate 31 is disposed on the radial outer side of an intermediate communicating portion 35 so as to extend between the first partition 23 and the cover portion 17 along the axis P. That is, the perforated plate 31 radially divides the high frequency-side processing space 25. The perforated plate 31 has a plurality of through holes 33 for passing gas therethrough. In the present embodiment, the plurality of through holes 33 are distributed in the almost entire axial and radial area of the perforated plate 31. The perforated plate 31 has the coupling hole 31*a* for communication with the draw-out portion 16. A rear air layer (rear fluid layer) 34 is formed in a space that is located on the radial outer side of the perforated plate 31 and on the radial inner side of a wall 14*c* of the silencer body 14 in the high frequency-side processing space 25. Pressure attenuation occurs due to viscous friction between medium (air and so on) in the through holes 33 and the inner wall face with respect to sound waves. Pressure attenuation also occurs due to an eddy generated when the medium is ejected through the through holes 33 into the rear air layer 34. These types of pressure attenuation exert the sound absorbing effect. Especially, the pressure attenuation caused by viscous friction between the medium and the inner wall face is so effective for sound having resonant frequency, and the resonant frequency may be set in any manner according to the thickness of the rear air layer, the sectional area of the holes, the opening ratio, or the plate thickness. The diameter of the through hole 33 may be set in any manner, and is 1 mm in the present embodiment.

The first partition 23 extends orthogonal to the axis P of the silencer body 14. The first partition 23 partitions the silencer body into the most downstream high frequency-side attenuating portion 22, and the most upstream low frequency-side attenuating portion 21 located adjacent to the high frequency-side attenuating portion 22 along the axis P. The first partition 23 is provided with the intermediate communicating portion 35. The intermediate communicating portion 35 is located coaxially with the axis P, and communicates the high frequency-side attenuating portion 22 with the low frequency-side attenuating portion 21. The path sectional area of the intermediate communicating portion 35 is expressed as S4. The path sectional area S4 is smaller than the path sectional area S2 of the low frequency-side attenuating portion 21, as well as a path sectional area S5 of the high frequency-side attenuating portion 22. One end of the perforated plate 31 is located at the first partition 23, and the other end of the perforated plate 31 is located at the cover portion 17.

The cover portion 17 has the substantially same outer shape as the opening 20 of the silencer body 14, and detachably closes the opening 20. The cover portion 17 is fastened to the silencer body 14 with a bolt (not illustrated).

The valve portion 18 includes a valve body 18*a* and a biasing member 18*b*. The valve portion 18 is disposed on the inner side of the perforated plate 31 coaxially with the axis P. The valve body 18*a* can press an axial front end 18*c* onto the intermediate communicating portion 35, thereby closing the intermediate communicating portion 35. The biasing member 18*b* is fixed to the cover portion 17 at one end 18*d*, and to the valve body 18*a* at the other end 18*e*. A length of the biasing member 18*b* is set such that the valve body 18*a* is elastically biased along the axis P to close the intermediate communicating portion 35, in the state where the cover portion 17 is attached to the opening 20 of the silencer body 14. In FIG. 2, the valve portion 18 is pressed by fluid, and the biasing member 18*b* becomes contracted most. In other words, in FIG. 2, the valve portion 18 has the largest degree of opening. In a space formed between the valve portion 18 and the first partition 23 at this position (a hatched area surrounded with a dotted line in FIG. 2), a surface area (virtual extended area S3) of a cylindrical region formed by extending the inner circumferential face of the intermediate communicating portion 35 to the end face of the valve portion 18 on the side of the first partition 23 is larger than the path sectional area 51 of the draw-in portion 15.

When the screw compressor is activated, compressed air is discharged through the discharge port 27 of the screw compressor body 11 into the discharge path 13, and the compressed air is introduced through the draw-in portion 15 into the low frequency-side attenuating portion 21. At this time, the path sectional area of the compressed air becomes large. That is, since the impedance rapidly changes, sound in a low frequency range is reflected within the low frequency-side attenuating portion 21, and becomes attenuated. Specifically, the sound is reflected on the boundary between the draw-in portion 15 and the low frequency-side processing space 24, and the boundary between the intermediate communicating portion 35 and the low frequency-side processing space 24, and becomes attenuated.

Then, the compressed air with sound waves in the low frequency range attenuated passes through the intermediate communicating portion 35, presses back the valve body 18*a* of the valve portion 18 against a biasing force of the biasing member 18*b* toward the opening 20, and enters into the high frequency-side attenuating portion 22 having a larger path sectional area. Thereby, as in the case where compressed air enters into the low frequency-side attenuating portion 21, sound waves of compressed air that entered into the high frequency-side attenuating portion 22 are reflected within the high frequency-side attenuating portion 22, and become attenuated. The compressed air that entered into the high frequency-side attenuating portion 22 passes through the coupling hole 31*a* of the perforated plate 31, and enters into the draw-out portion 16. At this time, since a diameter of the valve body 18*a* is larger than a diameter of the inner circumferential face of the intermediate communicating portion 35, compressed air flowing along the axis P of the silencer body 14 detours the valve body 18*a*, and turns in a direction other than the axis P of the silencer body 14, such that a portion of compressed air passes through the plurality of through holes 33 of the perforated plate 31. When compressed air passes through the plurality of through holes 33, pressure attenuation occurs due to viscous friction between compressed air in the through holes 33 and the inner wall face. Further, pressure attenuation also occurs due to an eddy generated when compressed air is ejected through the through holes 33, exerting the sound absorbing effect. After that, compressed air in the rear air layer 34 passes through the plurality of through holes 33, enters into the inner side of the perforated plate 31 and then, merges with compressed air entering from the intermediate communicating portion 35 into the draw-out portion 16. In this manner, sound generated at compression of air can be attenuated by passing through the silencer 10.

In the present embodiment, since the valve portion 18 is disposed in the most downstream attenuating portion, the silencer 10 can be made compact. By providing the first partition 23 between the attenuating portions 21, 22 disposed in the silencer body 14 in the flowing direction of fluid with the intermediate communicating portion 35, sound waves can be attenuated in a wide frequency range. Accordingly, sound in a wide frequency range can be attenuated with compact configuration.

Since the biasing member 18*b* biases the valve body 18*a* toward the intermediate communicating portion 35, backflow can be prevented, that is, fluid can be prevented from flowing from the high frequency-side attenuating portion 21 to the low frequency-side attenuating portion 22 through the intermediate communicating portion 35. Since the valve portion 18 is provided on the cover portion 17 which is detachably attached to the silencer body 14, the draw-out portion 16 is provided at the portion of the silencer body 14 other than the cover portion 17, the valve portion 18 can be maintained without detaching piping located downstream from the draw-out portion 16. That is, attenuation of sound in a wide frequency range, and simple maintenance of the valve portion 18 for preventing backflow of fluid can be achieved with compact configuration.

In the silencer 10, the path sectional area S5 of the most downstream high frequency-side attenuating portion 22 and the path sectional area S2 of the low frequency-side attenuating portion 21 each are larger than the path sectional area S4 of the intermediate communicating portion 35. Sound generated when fluid passes can be attenuated by varying the path sectional area.

Since the silencer body 14 includes the opening 20 closed with the cover portion 17, the valve portion 18 can be readily maintained.

Since the low frequency-side attenuating portion 21 and the high frequency-side attenuating portion 22 are provided, sound in a wide frequency range ranging from the lower frequency range to the higher frequency range can be attenuated.

Second Embodiment

Figure 3:
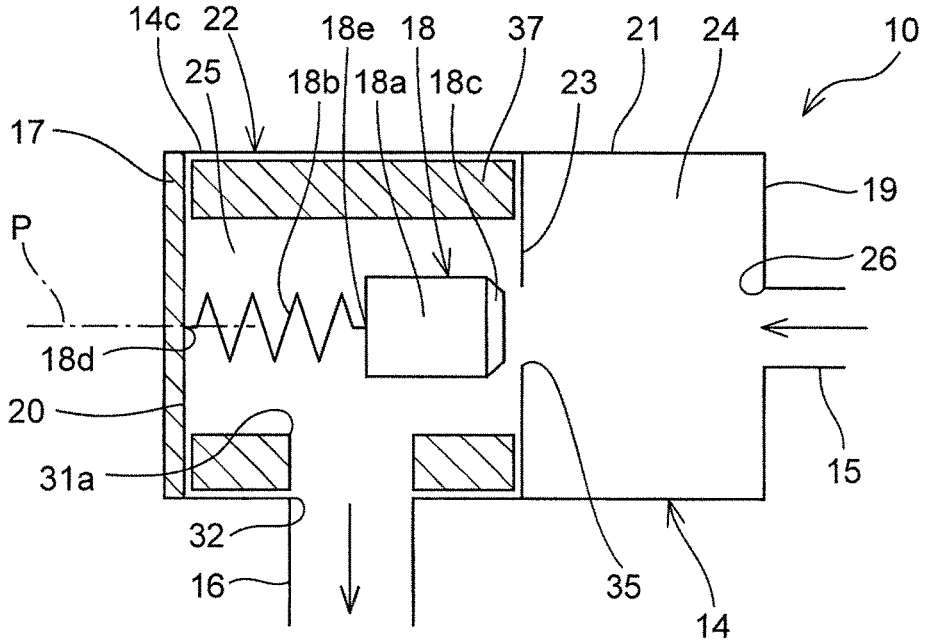
FIG. 3 is a schematic longitudinal-sectional view of a silencer in accordance with a second embodiment of the present invention.

FIG. 3 illustrates a silencer 10 in accordance with a second embodiment of the present invention. A low frequency-side attenuating portion 21 is disposed on the upstream side (near a closed section 19). A high frequency-side attenuating portion 22 is disposed on the downstream side (on the side of an opening 20). The high frequency-side attenuating portion 22 is a sound absorbing chamber having a sound absorbing member 37 for absorbing sound waves in a high frequency range. The sound absorbing member 37 is a cylindrical member made of a porous material such as glass wool and rock wool. The sound absorbing member 37 has a larger inner diameter than an inner diameter of an intermediate communicating portion 35, and the substantially same outer diameter as an inner diameter of a side wall 14*c* of a silencer body 14. A coupling hole 31*a* is provided at a position corresponding to an outflow port 32 of the sound absorbing member 37 to allow air to eject through a draw-out portion 16.

As in the first embodiment, compressed air that entered into the high frequency-side attenuating portion 22 enters into the draw-out portion 16. At this time, compressed air travelling along the axis P of the silencer body 14 is bent in the direction orthogonal to the axis P of the silencer body 14. At a result, a portion of compressed air deviates from the flowing direction, advances toward the sound absorbing member 37, and is incident on the sound absorbing member 37. The incidence absorbs sound waves in a high frequency range in compressed air. After that, the compressed air incident on the sound absorbing member 37 merges with the compressed air entering from the intermediate communicating portion 35 into the draw-out portion 16. In this manner, sound emitted when compressed air passes through the discharge path 13 can be attenuated by passing through the silencer 10.

The other configuration and effects of the second embodiment is the same as those in the first embodiment.

Third Embodiment

Figure 4:
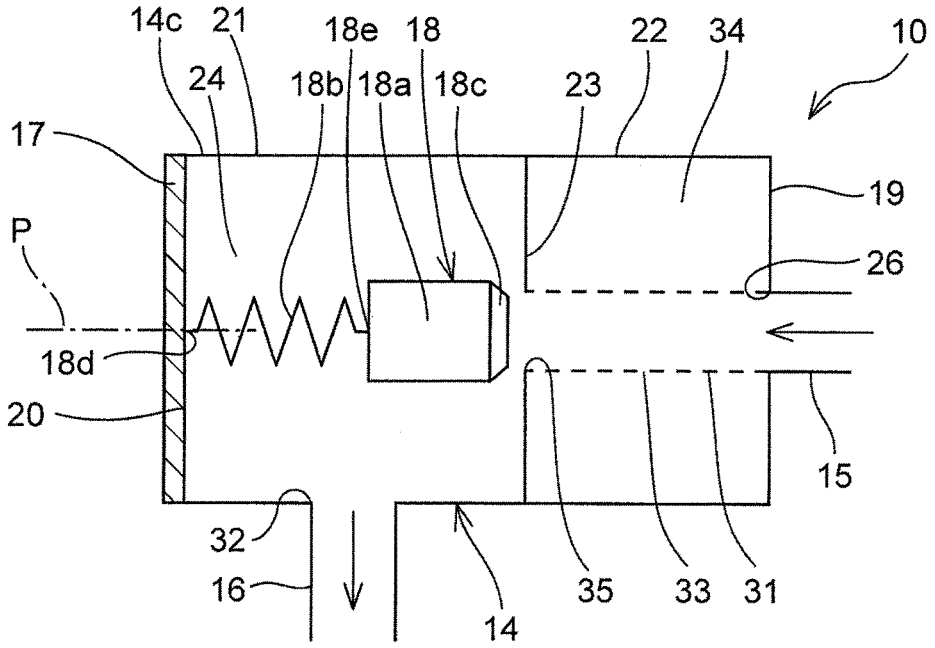
FIG. 4 is a schematic longitudinal-sectional view of a silencer in accordance with a third embodiment of the present invention.

FIG. 4 illustrates a silencer 10 in accordance with a third embodiment of the present invention. A high frequency-side attenuating portion 22 is disposed on the upstream side (on the side of a closed section 19). A low frequency-side attenuating portion 21 is disposed on the downstream side (on the side of an opening 20). The high frequency-side attenuating portion 22 is a sound absorbing chamber having a perforated plate 31. An inflow port 26 is provided at the high frequency-side attenuating portion 22 of the silencer body 14. The inflow port 26 is coaxial with the axis P of the silencer body 14. The perforated plate 31 axially extends between the closed section 19 and the first partition 23. The perforated plate 31 is attached to each of an end of the inflow port 26 and an end of a first partition 23.

Compressed air in a draw-in portion 15 enters into the high frequency-side attenuating portion 22, passes through the intermediate communicating portion 35, presses back a valve body 18*a* of a valve portion 18 against a biasing force of a biasing member 18*b* toward the opening 20, and enters into the low frequency-side attenuating portion 21. At this time, a portion of compressed air that entered into the high frequency-side attenuating portion 22 passes through a plurality of through holes 33 of the perforated plate 31. When compressed air passes through the plurality of through holes 33, pressure attenuation occurs due to viscous friction between compressed air in the through holes 33 and the inner wall face. Pressure attenuation also occurs due to an eddy generated when compressed air is ejected from the through holes 33. The pressure attenuation exerts the sound absorbing effect. After that, compressed air in a rear air layer 34 passes through the plurality of through holes 33, enters into the perforated plate 31 and then, merges with compressed air entering from the high frequency-side attenuating portion 22 into the intermediate communicating portion 35. Compressed air that entered into the low frequency-side attenuating portion 21 passes through the outflow port 32, and enters into the draw-out portion 16. When compressed air enters from the intermediate communicating portion 35 into the low frequency-side attenuating portion 21, the path sectional area of compressed air changes. That is, since the impedance rapidly changes, sound in a low frequency range is reflected in the low frequency-side attenuating portion 21, and becomes attenuated. Since a diameter of the valve body 18*a* is larger than a diameter of the intermediate communicating portion 35, compressed air detours the valve body 18*a*, and the low frequency-side attenuating portion 21 acoustically functions as an extended chamber. In this manner, sound generated when air is compressed can be attenuated by passing through the silencer 10.

The other configuration and effects of the third embodiment is the same as those in the first embodiment.

Fourth Embodiment

Figure 5:
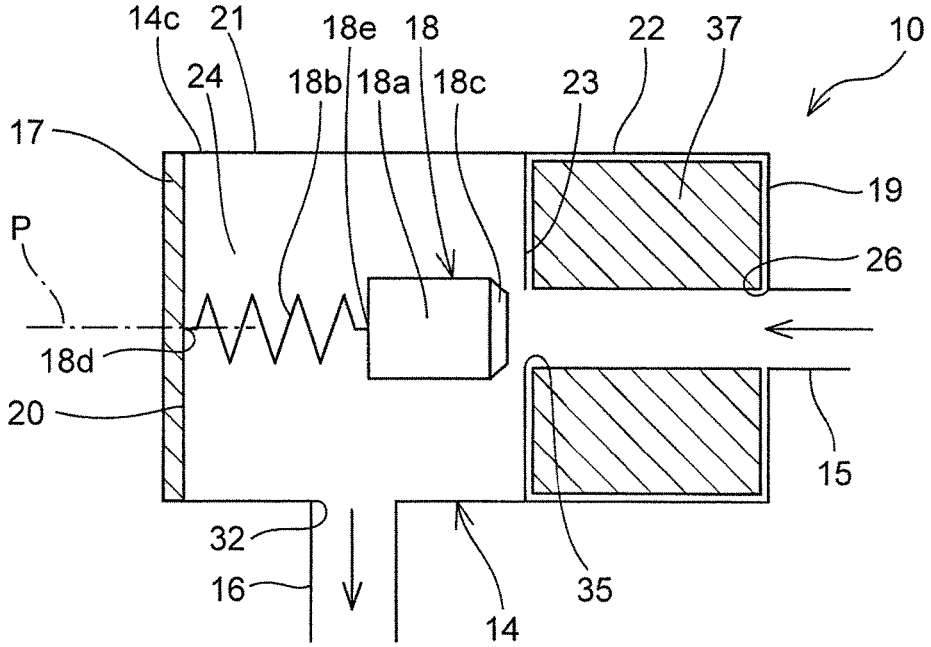
FIG. 5 is a schematic longitudinal-sectional view of a silencer in accordance with a fourth embodiment of the present invention.

FIG. 5 illustrates a silencer 10 in accordance with a fourth embodiment of the present invention. A high frequency-side attenuating portion 22 is disposed on the upstream side (on the side of a closed section 19). A low frequency-side attenuating portion 21 is disposed on the downstream side (on the side of an opening 20). The high frequency-side attenuating portion 22 is a sound absorbing chamber having a sound absorbing member 37 for absorbing sound waves in a high frequency range. An inner diameter of the sound absorbing member 37 is the substantially same as an inner diameter of a draw-in portion 15, and an inner diameter of an intermediate communicating portion 35, and an outer diameter of the sound absorbing member 37 is the substantially same as an inner diameter of a side wall 14*c* of the silencer body 14.

In the present embodiment, a portion of compressed air that entered into the high frequency-side attenuating portion 22 advances toward the sound absorbing member 37, and is incident on the sound absorbing member 37. The incidence absorbs sound waves in a high frequency range in compressed air. After that, compressed air incident on the sound absorbing member 37 merges with compressed air entering from the high frequency-side attenuating portion 22 into the intermediate communicating portion 35.

The other configuration and effects of the fourth embodiment is the same as those in the first embodiment.

Fifth Embodiment

Figure 6:
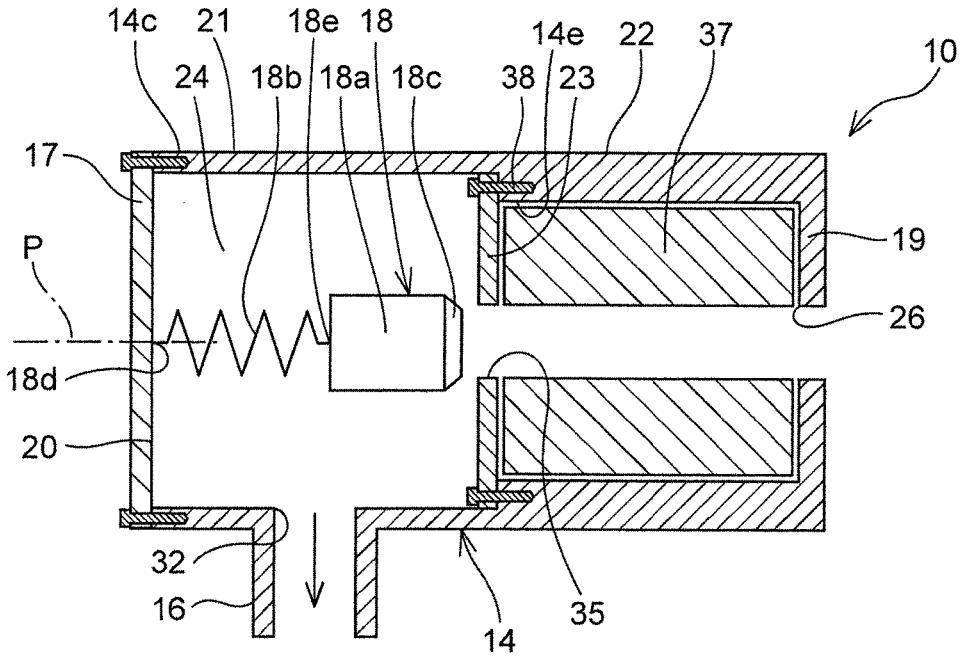
FIG. 6 is a schematic longitudinal-sectional view of a silencer in accordance with a fifth embodiment of the present invention.

FIG. 6 illustrates a silencer 10 in accordance with a fifth embodiment of the present invention. A silencer body 14 is integrally molded by casting or the like. A high frequency-side attenuating portion 22 is disposed on the upstream side (on the side of a closed section 19). A low frequency-side attenuating portion 21 is disposed on the downstream side (on the side of an opening 20). The high frequency-side attenuating portion 22 is a sound absorbing chamber having a sound absorbing member 37 for absorbing sound waves in a high frequency range. A side wall 14*c* of the silencer body 14 is provided with an inner flange 14*e*. A first partition 23 in the present embodiment is a partitioning plate separated from the silencer body 14. The first partition 23 is fastened to the inner flange 14*e* with a bolt 38. The first partition 23 restricts the sound absorbing member 37 accommodated in the high frequency-side attenuating portion 22 from moving to the low frequency-side attenuating portion 21.

With the above configuration, by detaching the cover portion 17 from the silencer body 14 and detaching the first partition 23 from the silencer body 14, the sound absorbing member 37 accommodated in the high frequency-side attenuating portion 22 that is the adjacent attenuating portion can be readily maintained. When used in the pressure pulsating state, the sound absorbing member 37 may change with time, and may be compressed onto the inner wall of the silencer body 14 and become deformed to be thin and hard. In this case, at passage of compressed air, the sound absorbing member 37 does not attenuate sound, or the sound absorbing member 37 itself does not cause friction, degrading the sound absorbing performance. The thickness of the sound absorbing member 37 affects the frequency at which the high frequency-side attenuating portion 22 as the sound absorbing chamber is effective. That is, the thin sound absorbing member 37 may not exert appropriate sound absorbing characteristics in a lower frequency range. With the configuration in the present embodiment, the hardened or deformed sound absorbing member 37 can be readily exchanged.

The other configuration and effects of the fifth embodiment is the same as those in the fourth embodiment.

Sixth Embodiment

Figure 7:
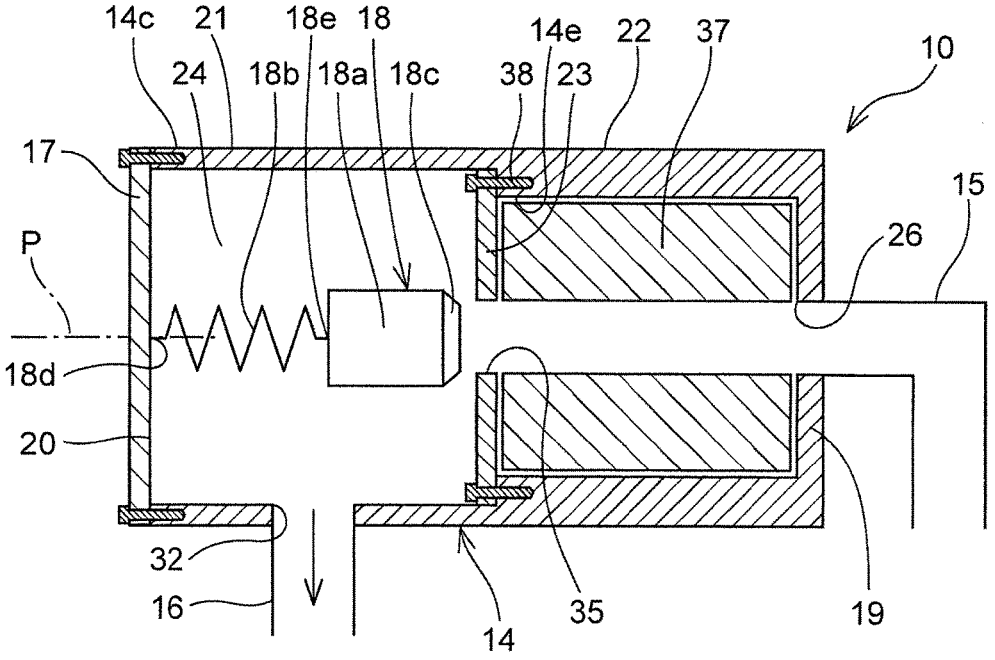
FIG. 7 is a schematic longitudinal-sectional view of a silencer in accordance with a sixth embodiment of the present invention.

FIG. 7 illustrates a silencer 10 in accordance with a sixth embodiment of the present invention. A draw-in portion 15 has a bent portion near an inflow port 26 of a silencer body 14. This configuration can change the flowing direction of fluid. That is, since sound can be deviated from a direction other than the flowing direction of fluid in the high frequency-side attenuating portion 22, thereby attenuating sound in a high frequency range in the high frequency-side attenuating portion 22 more effectively.

The other configuration and effects of a sixth embodiment is the same as those in the fifth embodiment.

Sound waves in a high frequency range may escape in a beam shape. Thus, the high frequency-side attenuating portion 22 in which compressed air advances in one direction may not achieve a sufficient silencing effect. The direction of the path can be changed upstream of the high frequency-side attenuating portion 22 using a pipe bending tool or the like, to change the direction of sound, and in turn, make sound waves incident on the sound absorbing member 37 with some angle. This can reduce sound even in a high frequency range.

Seventh Embodiment

Figure 8:
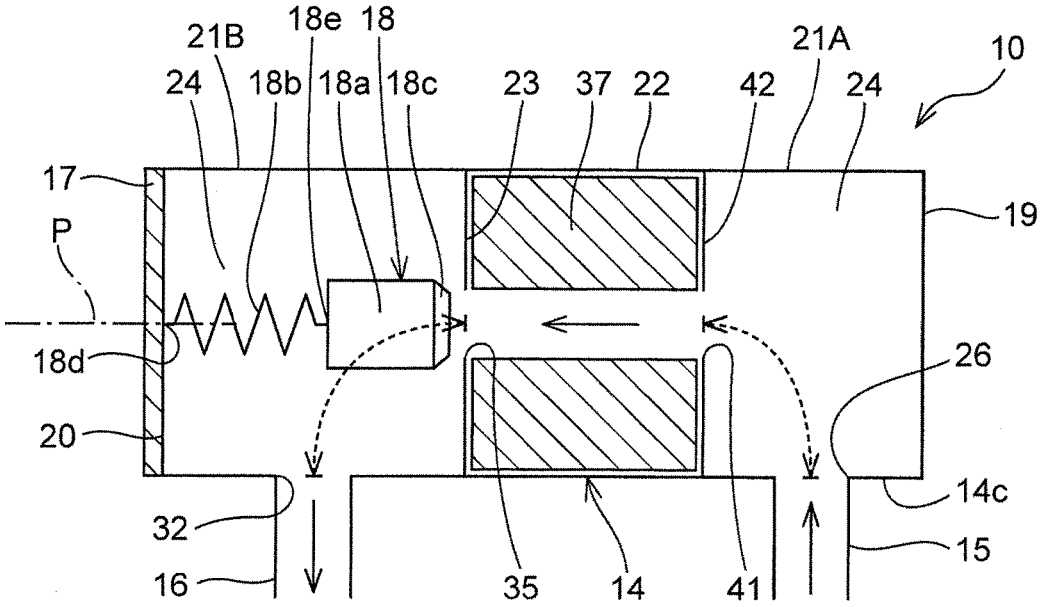
FIG. 8 is a schematic longitudinal-sectional view of a silencer in accordance with a seventh embodiment of the present invention.

FIG. 8 illustrates a silencer 10 in accordance with a seventh embodiment of the present invention. In a silencer body 14, a low frequency-side attenuating portion 21A, a high frequency-side attenuating portion (adjacent attenuating portion) 22, and a low frequency-side attenuating portion 21B are provided from the upstream side (on the side of a closed section 19) toward the downstream side (on the side of an opening 20). The draw-in portion 15 is disposed on a portion of the silencer body 14 other than an axial end of the most upstream low frequency-side attenuating portion 21A, that is, on a side wall 14*c* of the silencer body 14. A first partition 23 having an intermediate communicating portion 35 is provided between the high frequency-side attenuating portion 22 and the most downstream low frequency-side attenuating portion 21B. Similarly, a first partition 42 having an intermediate communicating portion 41 is provided between the most upstream low frequency-side attenuating portion 21A and the high frequency-side attenuating portion 22.

Compressed air in a draw-in portion 15 is introduced into the most upstream low frequency-side attenuating portion 21A. At this time, the path sectional area of compressed air changes. That is, since the impedance rapidly changes, sound in a low frequency range is reflected in the low frequency-side attenuating portion 21A, and becomes attenuated. After that, the travelling direction of compressed air is bent to the direction of the axis P of the silencer body 14, which is the axial direction of the draw-in portion 15. Thus, components of compressed air in the direction other than the axial direction advance toward the sound absorbing member 37, and are incident on the sound absorbing member 37. The incidence absorbs sound waves in a high frequency range in compressed air. Then, compressed air incident on the sound absorbing member 37 merges with compressed air entering from the most upstream low frequency-side attenuating portion 21A into the intermediate communicating portion 35. Moreover, due to a change in the cross section at an outlet of the high frequency-side attenuating portion 22, sound is further attenuated.

This configuration can prevent an increase in the axial dimension of the silencer 10. The other configuration and effects of the seventh embodiment is the same as those in the fourth embodiment.

Sound waves in a high frequency range may escape in a beam shape. Thus, the high frequency-side attenuating portion 22 in which compressed air advances in one direction may not achieve a sufficient silencing effect. The direction of the path can be changed upstream of the high frequency-side attenuating portion 22 using a pipe bending tool or the like, to change the direction of sound, and in turn, make sound waves incident on the sound absorbing member 37 with some angle. This can reduce sound even in a high frequency range.

Eighth Embodiment

Figure 9:
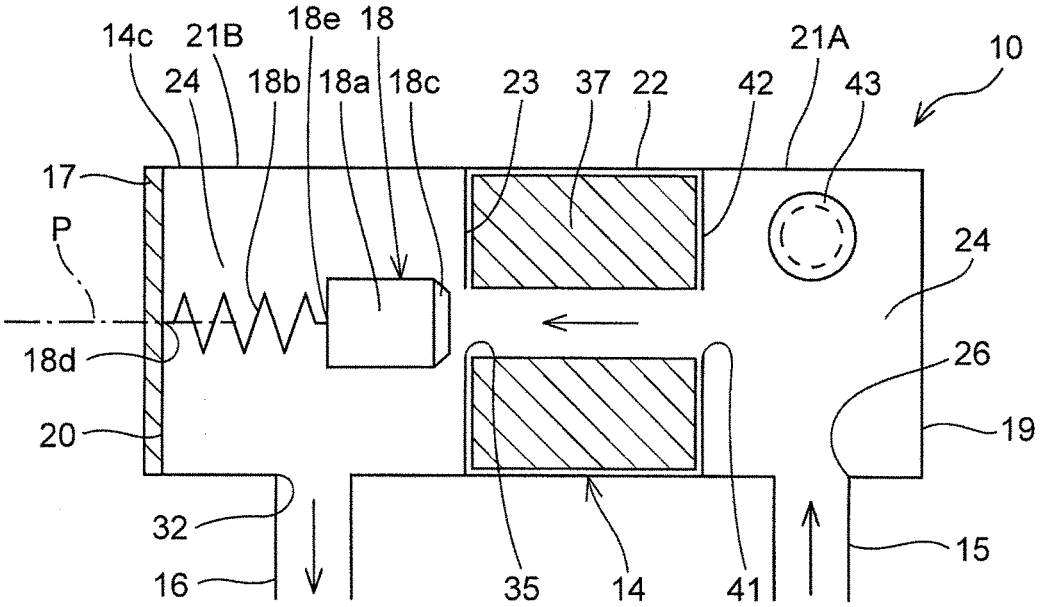
FIG. 9 is a schematic longitudinal-sectional view of a silencer in accordance with an eighth embodiment of the present invention.
Figure 10:
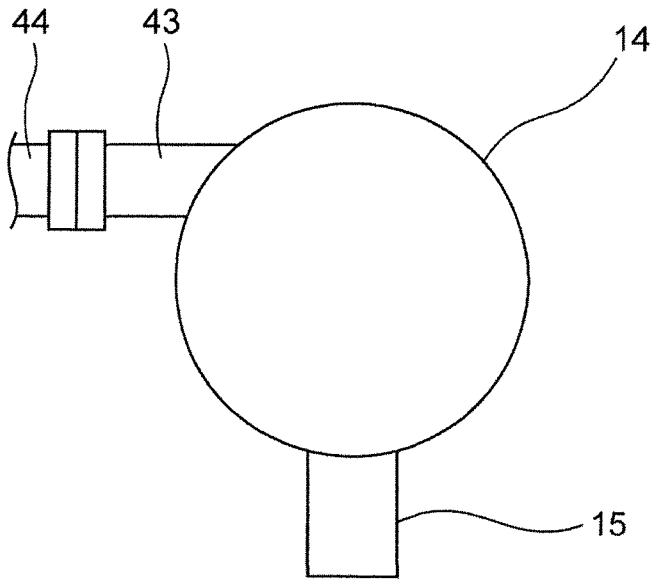
FIG. 10 is a schematic longitudinal-side view of the silencer in accordance with the eighth embodiment of the present invention.

FIG. 9 and FIG. 10 illustrate a silencer 10 in accordance with an eighth embodiment of the present invention. In a silencer body 14, a low frequency-side attenuating portion 21A, a high frequency-side attenuating portion (adjacent attenuating portion) 22, and a low frequency-side attenuating portion 21B are provided from the upstream side (on the side of the closed section 19) toward the downstream side (on the side of the opening 20). As illustrated in FIG. 9 and FIG. 10, the most upstream low frequency-side attenuating portion 21A is provided with a bypass pipe 43. An end of the bypass pipe 43 is connected to an atmosphere opened path 44 opened to the atmosphere.

During unloading of the screw compressor body 11, a screw body (not illustrated) is rotating, but discharge of compressed air stops to close the valve portion 18 of the silencer body 14. To reliably prevent a pressure increase in the discharge path 13 due to opening of the valve portion 18 during unloading of the screw compressor body 11, the bypass pipe 43 and the atmosphere opened path 44 are provided.

With this configuration, even when passage of fluid stops to open the valve portion 18, and the pressure in the most upstream low frequency-side attenuating portion 21A increases, fluid can be drawn out through the bypass pipe 43. This can prevent the pressure in the low frequency-side attenuating portion 21A from keeping high. The most upstream low frequency-side attenuating portion 21A can be provided with the bypass pipe 43, to use the attenuating portion as a side branch (resonator). The number of components can be reduced by incorporating the bypass pipe 43 into the silencer 10.

The other configuration and effects of the eighth embodiment is the same as those in the seventh embodiment.

Ninth Embodiment

Figure 11:
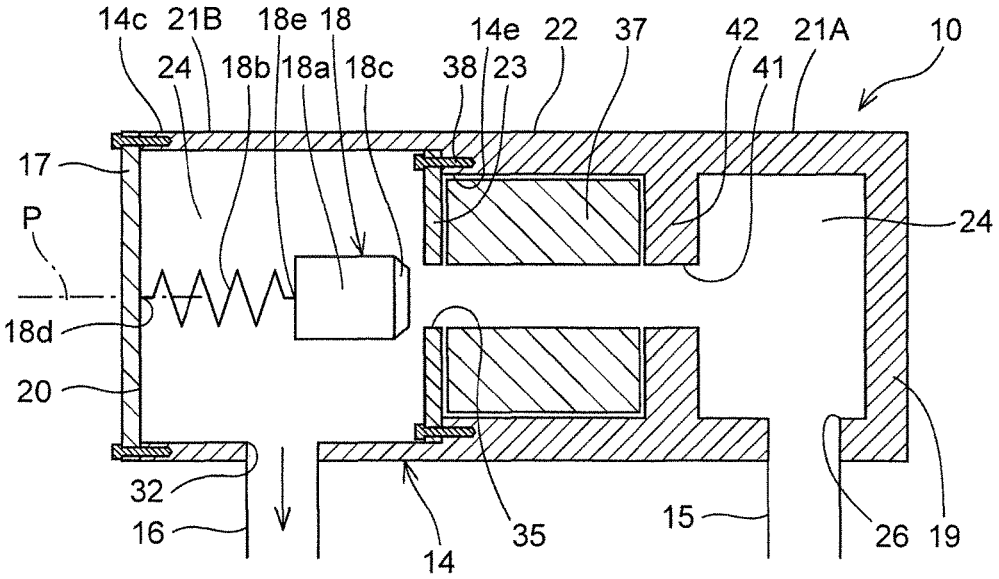
FIG. 11 is a schematic longitudinal-sectional view of a silencer in accordance with a ninth embodiment of the present invention.

FIG. 11 illustrates a silencer 10 in accordance with a ninth embodiment of the present invention. A silencer body 14 is integrally molded by casting or the like. In a silencer body 14, a low frequency-side attenuating portion 21A, a high frequency-side attenuating portion (adjacent attenuating portion) 22, and a low frequency-side attenuating portion 21B are provided from the upstream side (on the side of the closed section 19) toward the downstream side (on the side of the opening 20). The high frequency-side attenuating portion 22 is a sound absorbing chamber having a sound absorbing member 37 for absorbing sound waves in a high frequency range. A side wall 14*c* of the silencer body 14 is provided with an inner flange 14*e*. A first partition 23 in the present embodiment is a partitioning plate separated from the silencer body 14. The first partition 23 is fastened to an inner flange 14*e* with a bolt 38. The first partition 23 restricts the sound absorbing member 37 accommodated in the high frequency-side attenuating portion 22 from moving to the low frequency-side attenuating portion 21B. Thus, a silencer configured of a plurality of acoustic elements can be manufactured using a small number of components.

The other configuration and effects of the ninth embodiment is the same as those in the seventh embodiment.

Tenth Embodiment

Figure 12:
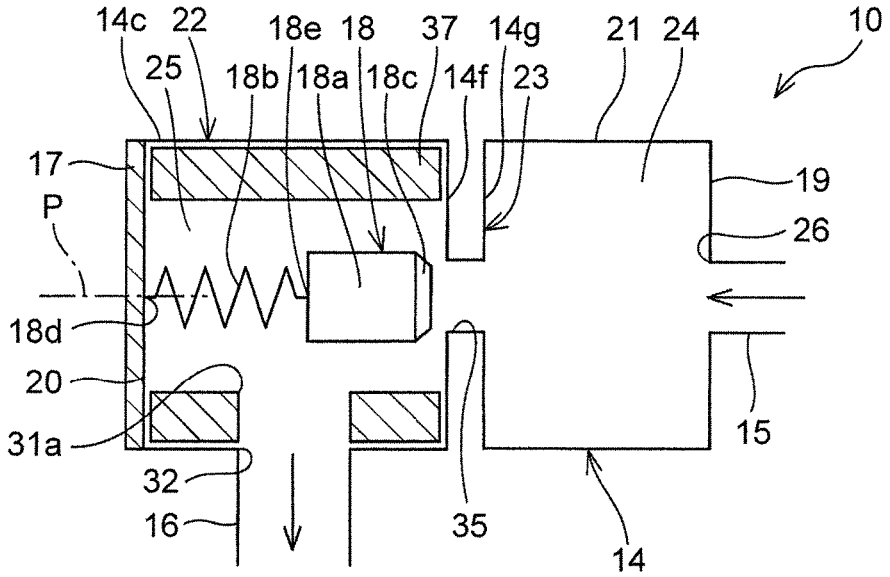
FIG. 12 is a schematic longitudinal-sectional view of a silencer in accordance with a tenth embodiment of the present invention.

FIG. 12 illustrates a silencer 10 in accordance with a tenth embodiment of the present invention. A low frequency-side attenuating portion 21 is disposed on the upstream side (on the side of a closed section 19). A high frequency-side attenuating portion 22 is disposed on the downstream side (on the side of an opening 20). The low frequency-side attenuating portion 21 is coupled to the high frequency-side attenuating portion 22 with a cylindrical intermediate communicating portion 35 having a predetermined axial length. That is, a first partition 23 is configured of an upstream wall 14*g* of the silencer body 14 defining the low frequency-side attenuating portion 21, a downstream wall 14*f* of the silencer body 14 defining the high frequency-side attenuating portion 22, and an intermediate communicating portion 35. The intermediate communicating portion 35 has a smaller path sectional area than the path sectional area of the low frequency-side attenuating portion 21, and the path sectional area of the high frequency-side attenuating portion 22.

The other configuration and effects of the tenth embodiment is the same as those in the second embodiment.

Eleventh Embodiment

Figure 13:
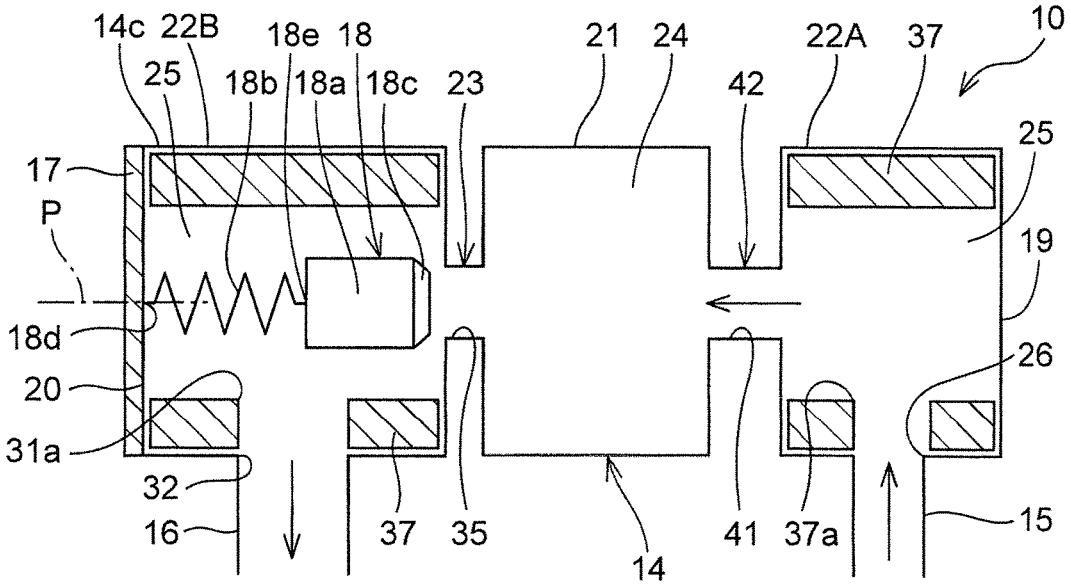
FIG. 13 is a schematic longitudinal-sectional view of a silencer in accordance with an eleventh embodiment of the present invention.

FIG. 13 illustrates a silencer 10 in accordance with an eleventh embodiment of the present invention. In a silencer body 14, a high frequency-side attenuating portion 22A, a low frequency-side attenuating portion (adjacent attenuating portion) 21, and a high frequency-side attenuating portion 22B are provided from the upstream side (the side of a closed section 19) toward the downstream side (the side of an opening 20). The high frequency-side attenuating portions 22A, 22B each are a sound absorbing chamber having a sound absorbing member 37 for absorbing sound waves in a high frequency range. An inflow port 26 is disposed in a portion of the silencer body 14 other than an end of the most upstream high frequency-side attenuating portion 22A in the direction of the axis P. A coupling hole 37*a* is provided at a position corresponding to the inflow port 26 in the sound absorbing member 37, to allow compressed air to flow therethrough from the draw-in portion 15. Like coupling between the high frequency-side attenuating portion 22B and the low frequency-side attenuating portion 21 with an intermediate communicating portion 35, the high frequency-side attenuating portion 22A is coupled to the low frequency-side attenuating portion 21 with an intermediate communicating portion 41 having a predetermined axial length.

Compressed air in the draw-in portion 15 enters into the most upstream high frequency-side attenuating portion 22A, and is bent to the direction of the axis P of the silencer body 14, which is different from the axial direction of the draw-in portion 15. For this reason, components of compressed air in the direction other than the axial direction advance toward the sound absorbing member 37, and are incident on the sound absorbing member 37. The incidence absorbs sound waves in a high frequency range in compressed air. After that, compressed air incident on the sound absorbing member 37 merges with compressed air entering from the most upstream high frequency-side attenuating portion 22A into the low frequency-side attenuating portion 21, and flows into the intermediate communicating portion 41. The flow of compressed air after passage through the intermediate communicating portion 41 is the same as the flow of compressed air after passage through the draw-in portion 15 in the silencer 10 in the tenth embodiment and thus, description thereof is omitted.

The other configuration and effects of the eleventh embodiment is the same as those in the tenth embodiment.

Twelfth Embodiment

Figure 14:
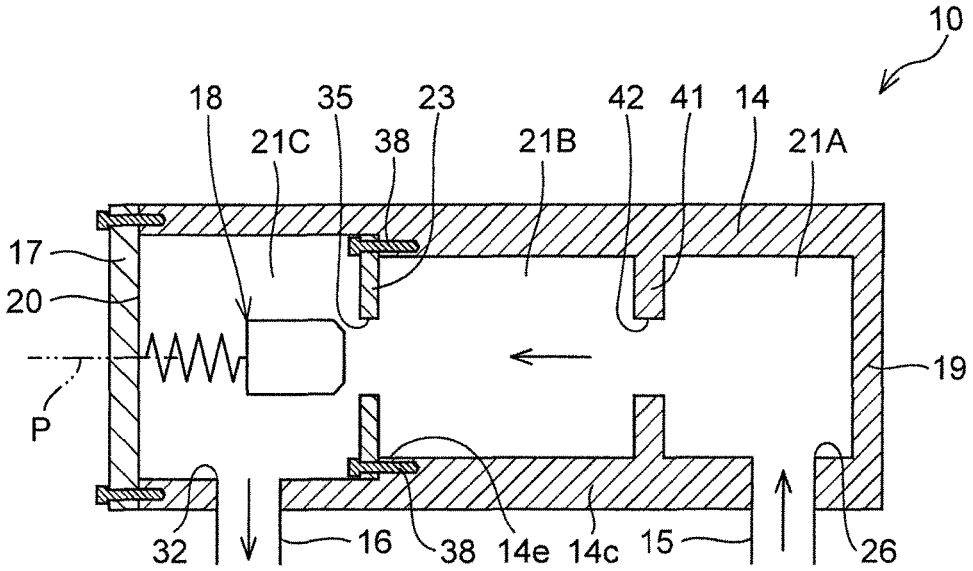
FIG. 14 is a schematic longitudinal-sectional view of a silencer in accordance with a twelfth embodiment of the present invention.

FIG. 14 illustrates a silencer 10 in accordance with a twelfth embodiment of the present invention. In a silencer body 14, a low frequency-side attenuating portion 21A, a low frequency-side attenuating portion 21B (adjacent attenuating portion), and a low frequency-side attenuating portion 21C are provided in this order from the upstream side (on the side of a closed section 19) toward the downstream side (on the side of an opening 20). A draw-in portion 15 is disposed in a portion of the silencer body 14 other than an axial end of the most upstream low frequency-side attenuating portion 21A, that is, a side wall 14*c* of the silencer body 14. A first partition 23 having an intermediate communicating portion 35 is provided between the low frequency-side attenuating portion 21B and the most downstream low frequency-side attenuating portion 21C. The first partition 23 is a partitioning plate separated from the silencer body 14. The first partition 23 is fastened to an inner flange 14*e* with a bolt 38. A first partition 42 having an intermediate communicating portion 41 is provided between the most upstream low frequency-side attenuating portion 21A and the low frequency-side attenuating portion 21B.

The other configuration and effects of the twelfth embodiment is the same as those in the seventh embodiment.

Thirteenth Embodiment

Figure 15:
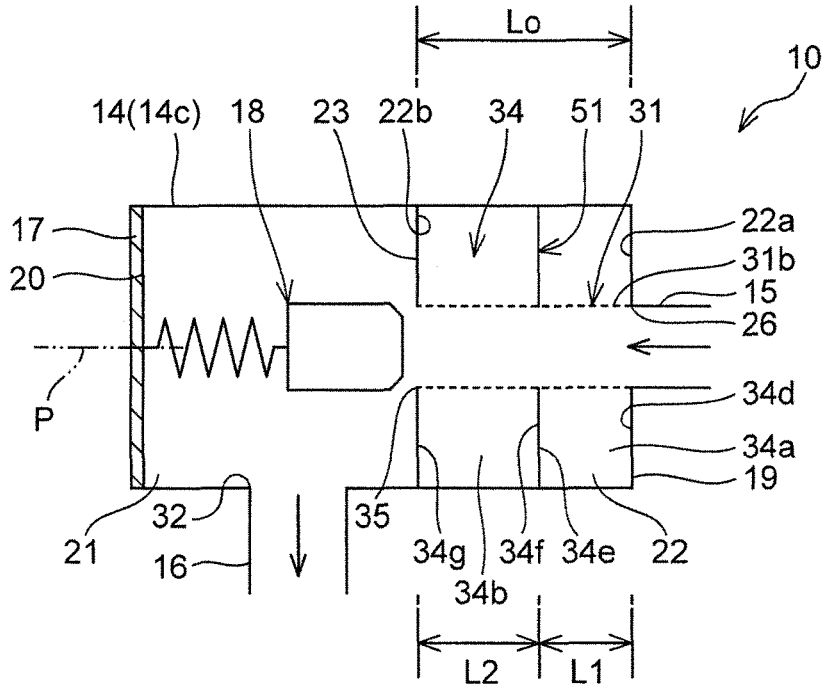
FIG. 15 is a schematic longitudinal-sectional view of a silencer in accordance with a thirteenth embodiment of the present invention.

FIG. 15 illustrates a silencer 10 in accordance with a thirteenth embodiment of the present invention. A high frequency-side attenuating portion 22 is disposed on the upstream side (on the side of a closed section 19). A low frequency-side attenuating portion 21 is disposed on the downstream side (on the side of an opening 20). The high frequency-side attenuating portion 22 is a sound absorbing chamber having a perforated plate 31.

The perforated plate 31 in the present embodiment is a tube having a lot of through holes 31*b*. A second partition 51 extending from the inner face of a side wall 14*c* of a silencer body 14 toward the perforated plate 31 is provided. The second partition 51 partitions a rear air layer 34 into a first region 34*a* and a second region 34*b*, which are aligned in the flowing direction of air in the perforated plate 31.

The second partition 51 can suppress resonance at a frequency of sound attenuated in the high frequency-side attenuating portion 22. This will be described below in detail.

A frequency of sound waves to be attenuated in the high frequency-side attenuating portion 22 is defined as ftag. A wavelength corresponding to ftag is defined as λtag (=sound speed/ftag). Given that no second partition 51 is provided, a distance between a pair of faces (opposite faces) 22*a*, 22*b* opposite to each other in the flowing direction of air in the rear air layer 34 of the silencer body 14 is defined as L0. A resonant wavelength λ0 in the rear air layer 34 is twice of the distance L0 (λ0=2L0). When the wavelength λtag is equal to the wavelength λ0, the rear air layer 34 resonates at the frequency ftag of sound waves to be attenuated, and the sound pressure increases in the vicinity of the opposite faces 22*a*, 22*b*. As a result, sound leaks from the rear air layer 34 to the perforated plate 31 through through holes 31*b*, lessening the silencing effect of the perforated plate 31 at the frequency ftag. In other words, apparently, the silencing effect of the perforated plate 31 at the frequency ftag cannot be appropriately acquired.

In the present embodiment, the second partition 51 partitions the rear air layer 34 into the first region 34*a* and the second region 34*b*. A distance between a pair of faces (opposite faces) 34*d*, 34*e* opposite to each other in the flowing direction of air in the first region 34*a* of the silencer body 14 is defined as L1. A distance between a pair of faces (opposite faces) 34*f*, 34*g* opposite to each other in the flowing direction of air in the second region 34*b* of the silencer body 14 is defined as L2. Resonant wavelengths λ1, λ2 in the first and second region 34*a*, 34*b* are twice of the distances L1, L2, respectively (λ1=2L1, λ2=2L2). Accordingly, the distance L1 (=λ1/2) and the distance L2 (=λ2/2) can be made different from ½ of λtag, preventing resonance at the frequency ftag to be attenuated from occurring in the rear air layer 34.

The first region 34*a* and the second region 34*b* divided with the second partition 51 can have different frequencies λtag' to be attenuated. In both of the first region 34*a* and the second region 34*b*, the frequency ftag' to be attenuated depends on the thickness of the perforated plate 31, the diameter of the through hole 31*b*, the opening ratio of the perforated plate 31, and the thickness of an effective air layer. As the perforated plate 31 is thicker, the frequency ftag' lowers. As the diameter of the through holes 31*b* is larger, the frequency ftag' lowers. The opening ratio is defined as a ratio of a porous area that is a sum of areas of the through holes 31*b* to an area of the perforated plate 31. As the opening ratio is higher, the frequency ftag' rises. The thickness of the effective air layer is defined as a ratio of a volume of the rear air layer 34 to the porous area that is a sum of areas of the through holes. As the effective air layer is thicker, the frequency ftag' lowers.

Figure 16:
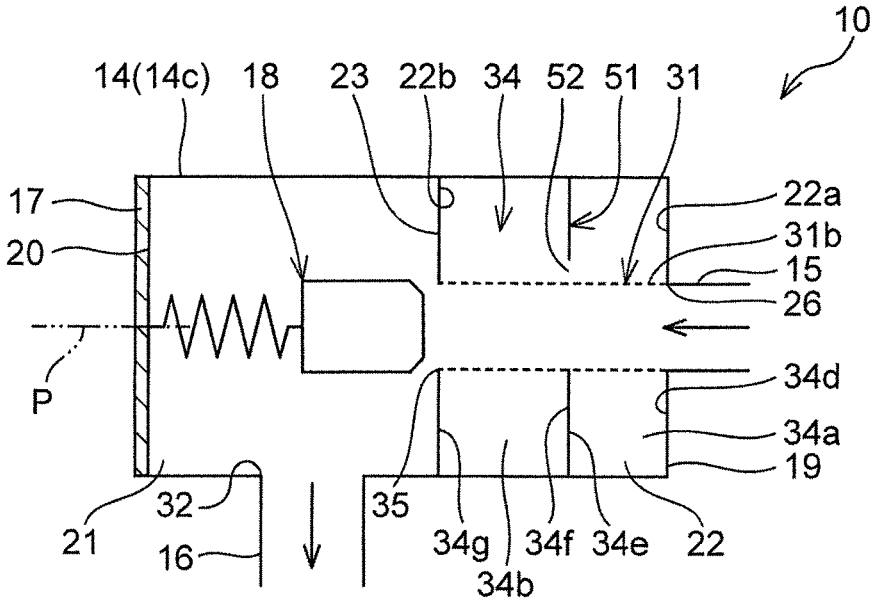
FIG. 16 is a schematic longitudinal-sectional view of a modification of the silencer in accordance with the thirteenth embodiment of the present invention.

In the present embodiment, a front end of the second partition 51 is in contact with the outer face of the perforated plate 31. In other words, the second partition 51 extends over the path sectional area in the flowing direction of air in the rear air layer 34. However, as in a modification illustrated in FIG. 16, a gap 52 may be formed between the front end of the second partition 51 and the outer face of the perforated plate 31. For example, the second partition 51 that extends 70% or more of the path sectional area in the flowing direction of air in the rear air layer 34 can suppress resonance at the frequency attenuated in the high frequency-side attenuating portion 22.

In the present embodiment, the second partition 51 is formed on the side wall 14*c* of the silencer body 14. Thus, in use, the perforated plate 31 can be detached from the silencer body 14. When the perforated plate 31 is detached, the first and second region 34*a*, 34*b* function as extended chambers (low frequency-side attenuating portions). Accordingly, the silencer 10 with the perforated plate 31 detached has three serially-arranged low frequency-side attenuating portions. By merely attaching or detaching the perforated plate 31 to or from the common silencer body 14, the silencer 10 can vary its characteristics, improving productivity.

The other configuration and effects of the thirteenth embodiment is the same as those in the third embodiment.

Fourteenth Embodiment

Figure 17:
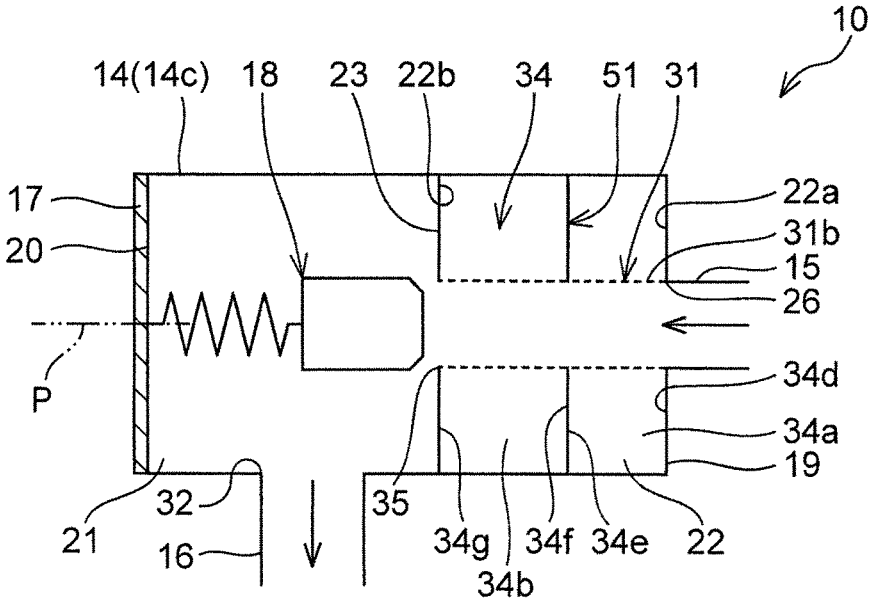
FIG. 17 is a schematic longitudinal-sectional view of a silencer in accordance with a fourteenth embodiment of the present invention.
Figure 18:
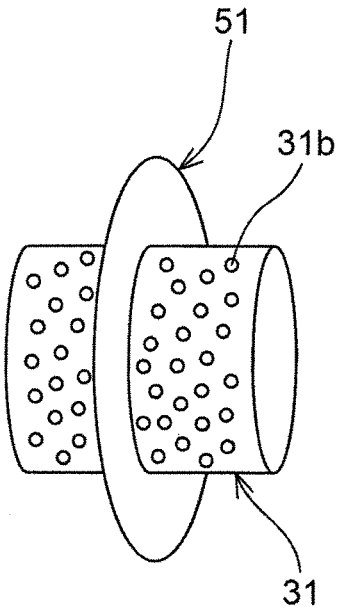
FIG. 18 is a schematic perspective view of a core body-type perforated plate.

FIG. 17 and FIG. 18 illustrate a silencer 10 in accordance with a fourteenth embodiment of the present invention. In the present embodiment, a second partition 51 is provided on a perforated plate 31 rather than a side wall 14*c* of the silencer body 14. In the present embodiment, a front end of the second partition 51 is in contact with the inner face of a side wall 14*c* of the silencer body 14. However, a gap may be formed between the front end of the second partition 51 and the inner face of the side wall 14*c*.

The other configuration and effects of the fourteenth embodiment is the same as those in the thirteenth embodiment.

Fifteenth Embodiment

Figure 19:
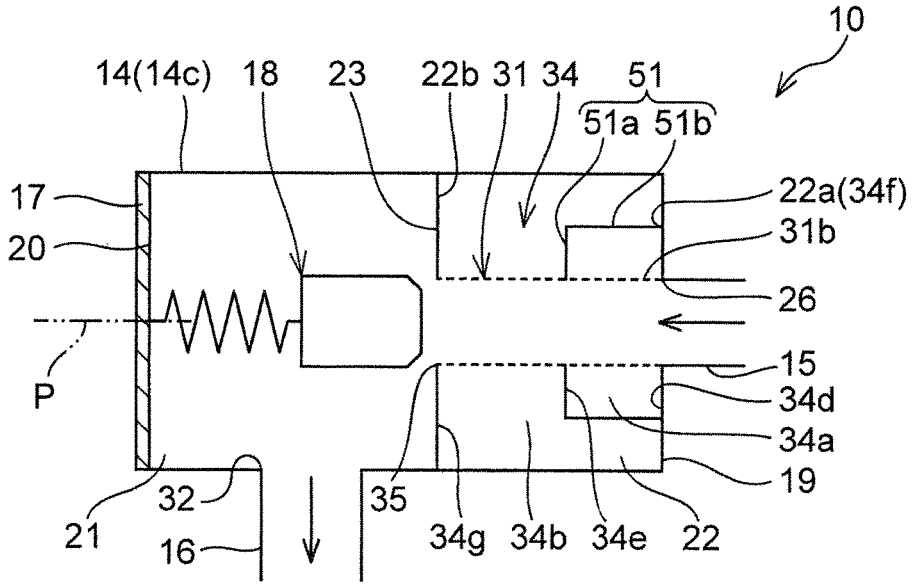
FIG. 19 is a schematic longitudinal-sectional view of a silencer in accordance with a fifteenth embodiment of the present invention.
Figure 20:
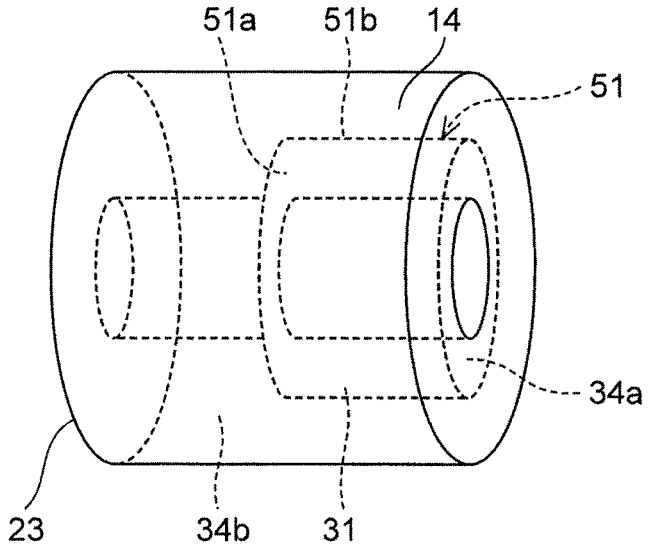
FIG. 20 is a conceptual perspective view illustrating a configuration of a rear air layer.

FIG. 19 and FIG. 20 illustrate a silencer 10 in accordance with a fifteenth embodiment of the present invention. In the present embodiment, a second partition 51 includes a first portion 51*a* and a second portion 51*b*. The first portion 51*a* is a plate extending over the path sectional area in the flowing direction of air in the rear air layer 34. A sufficient gap is formed between the first portion 51*a* and a side wall 14*c* of a silencer body 14. The second portion 51*b* is a tubular, and extends from the outer edge of the first portion 51*a* to the closed section 19 in the flowing direction of air in the rear air layer 34. Since the second partition 51 having the first and second portion 51*a*, 51*b* is adopted, the first region 34*a* and the second region 34*b* partially overlap each other in the flowing direction of air. Specifically, a portion of the second region 34*b* on the side of the closed section 19 surrounds the first region 34*a*. In other words, the second partition 51 and the side wall 14*c* of the silencer body 14 constitute the first and the second region 34*a*, 34*b* in the nested configuration. A volume of air in the second region 34*b* is larger than a volume of air in the first region 34*a*. Accordingly, when the thickness of the perforated plate 31, the diameter of the through hole 31*b*, and the opening ratio of the perforated plate 31 remains unchanged, the frequency ftag' of sound waves to be attenuated in the second region 34*b* is lower than the frequency ftag' of sound waves to be attenuated in the first region 34*a*. In the second region 34*b*, resonance between the opposite faces 22*a*, 22*b* occurs, and the sound pressure in the vicinity of the opposite faces 22*a*, 22*b* rises. However, since the position where the sound pressure rises is away from the perforated plate 31, the silencing effect of the perforated plate 31 is not lessened so much.

The nested configuration enables the rear air layer 34 to be divided into a plurality of regions of different volumes without increasing the axial dimension of the silencer body 14.

The other configuration and effects of the fifteenth embodiment is the same as those in the thirteenth embodiment.

Sixteenth Embodiment

Figure 21:
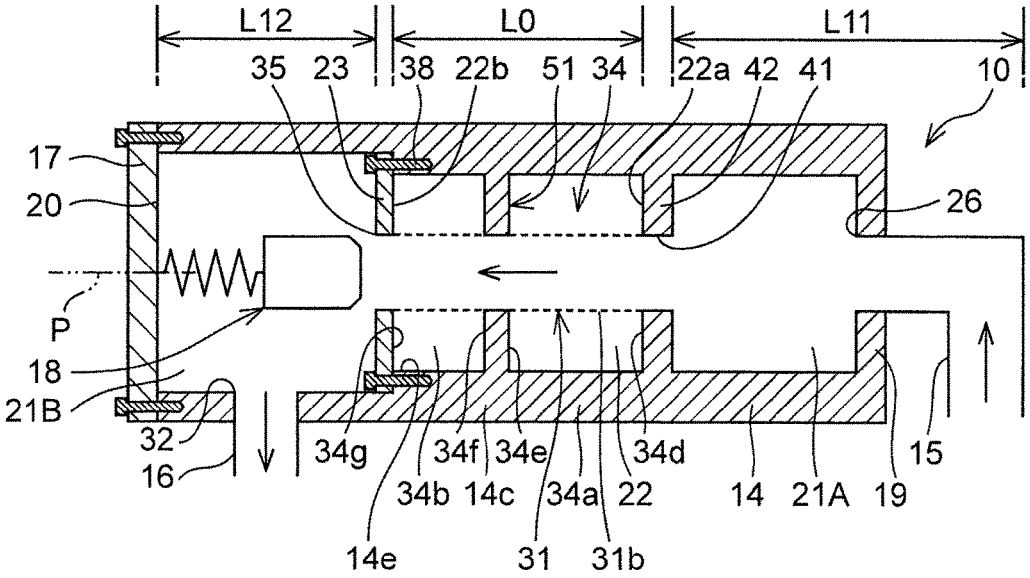
FIG. 21 is a schematic longitudinal-sectional view of a silencer in accordance with a sixteenth embodiment of the present invention.

FIG. 21 illustrates a silencer 10 in accordance with a sixteenth embodiment of the present invention. In a silencer body 14, a low frequency-side attenuating portion 21A, a high frequency-side attenuating portion 22 (adjacent attenuating portion), and a low frequency-side attenuating portion 21B are provided in this order from the upstream side (on the side of a closed section 19) toward the downstream side (on the side of an opening 20). A first partition 23 having an intermediate communicating portion 35 is provided between the high frequency-side attenuating portion 22 and the most downstream low frequency-side attenuating portion 21B. A first partition 23 in the present embodiment is a partitioning plate separated from the silencer body 14. The first partition 23 is fastened to an inner flange 14*e* with a bolt 38. A first partition 42 having an intermediate communicating portion 41 is provided between the most upstream low frequency-side attenuating portion 21A and the high frequency-side attenuating portion 22. A draw-in portion 15 has a bent portion near an inflow port 26 of the silencer body 14.

The high frequency-side attenuating portion 22 is provided with a perforated plate 32 and a second partition 51. A frequency ftag' of sound waves to be attenuated in a first region 34*a* and a second region 34*b* can be set based on the thickness of a perforated plate 31, the diameter of through holes 31*b*, the opening ratio of the perforated plate 31, and the thickness of an effective air layer. For example, the frequency ftag' of sound waves to be attenuated in the first region 34*a* may be made different from the frequency ftag' of sound waves to be attenuated in the second region 34*b*.

In the present embodiment, the most upstream attenuating portion is the low frequency-side attenuating portion 21A, and the high frequency-side attenuating portion 22 is adjacently provided downstream of the low frequency-side attenuating portion 21A. The perforated plate 31 has nonlinearity with respect to sound pressure, and as the sound pressure is higher, the silencing effect also becomes higher. For this reason, by disposing the high frequency-side attenuating portion 22 having the perforated plate 31 immediately behind the most upstream low frequency-side attenuating portion 21A, the nonlinearity of the perforated plate 31 with respect to sound pressure can be effectively used to acquire a higher silencing effect.

Sound waves in a high frequency range has a high straightness and thus, tend to pass through the perforated plate 31 without entering into the through holes 31*b* of the perforated plate 31. In the present embodiment, the bent portion of the draw-in portion 15 can bend or disturb the travelling direction of sound waves to orient sound waves toward the perforated plate 31, improving the sound attenuating effect in the high frequency-side attenuating portion 22. Even when the travelling direction of sound waves is bent once, sound waves tend to restore the original straightness after an advancement with a few wavelengths. When sound waves in a high frequency range and sound waves in a low frequency range advance by the same distance, sound waves in the high frequency range have a shorter wavelength and a larger wave number in the distance than sound waves in the low frequency range. Accordingly, sound waves in the high frequency range restore the straightness than sound waves in the low frequency range more readily. In the present embodiment, the high frequency-side attenuating portion 22 is adjacently provided downstream of the low frequency-side attenuating portion 21A, to which the draw-in portion 15 having the bent portion is connected. Thus, sound waves enters into the high frequency-side attenuating portion 22 immediately after bending or disturbing occurs in the travelling direction, enhancing the attenuating effect in the high frequency-side attenuating portion 22 more effectively.

Figure 22:
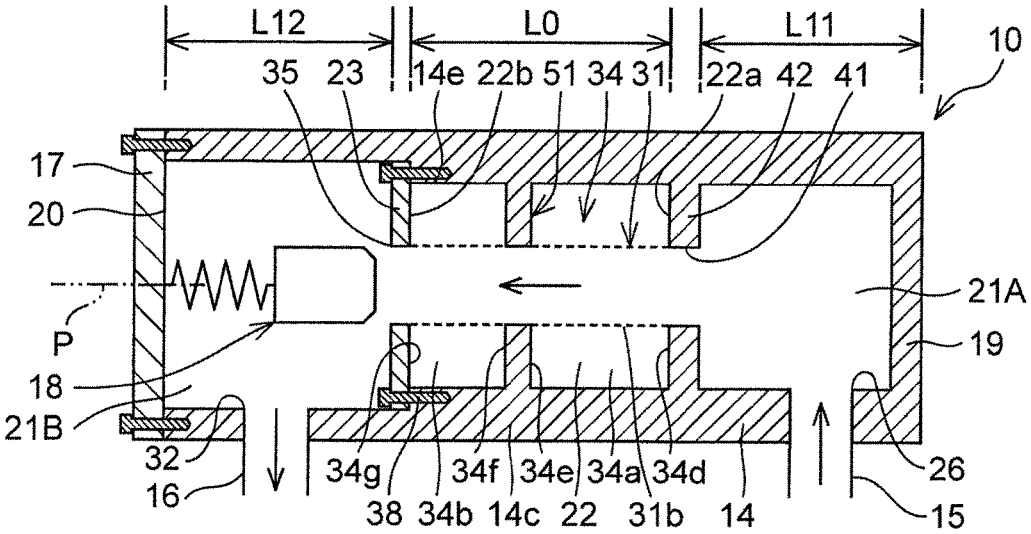
FIG. 22 is a schematic longitudinal-sectional view of a modification of a sixteenth embodiment.

In the present embodiment, the draw-in portion 15 includes the bent portion. However, as in a modification illustrated in FIG. 22, the travelling direction of sound wave may be bent by disposing the draw-in portion 15 at the portion of the silencer body 14 other than the axial end of the most upstream low frequency-side attenuating portion 21A, that is, the side wall 14*c* of the silencer body 14.

As described about the thirteenth embodiment, given that no second partition 51 is provided, the resonant wavelength λ0 in the rear air layer 34 is twice of the distance L0 in the flowing direction of air in the silencer body 14 (λ0=2L0). By setting a distance L11 between opposite faces of the low frequency-side attenuating portion 21A in the flowing direction of air (the distance including the bent portion in FIG. 21) to ½ of L0 (L11=L0/2=λ0/4), sound waves in the frequency range that resonates in the high frequency-side attenuating portion 22 can be previously reduced before entering into the high frequency-side attenuating portion 22. Similarly, by setting a distance L12 between opposite faces of the high frequency-side attenuating portion 22B in the flowing direction of air to ½ of L0 (L12=L0/2=λ0/4), sound waves in the frequency range that resonates in the high frequency-side attenuating portion 22 can be reduced. That is, setting the dimension in this manner can prevent degrading of silencing characteristics in a certain frequency range in the entire silencer 10.

The other configuration and effects of the sixteenth embodiment are the same as those in the thirteenth embodiment.

Seventeenth Embodiment

Figure 23:
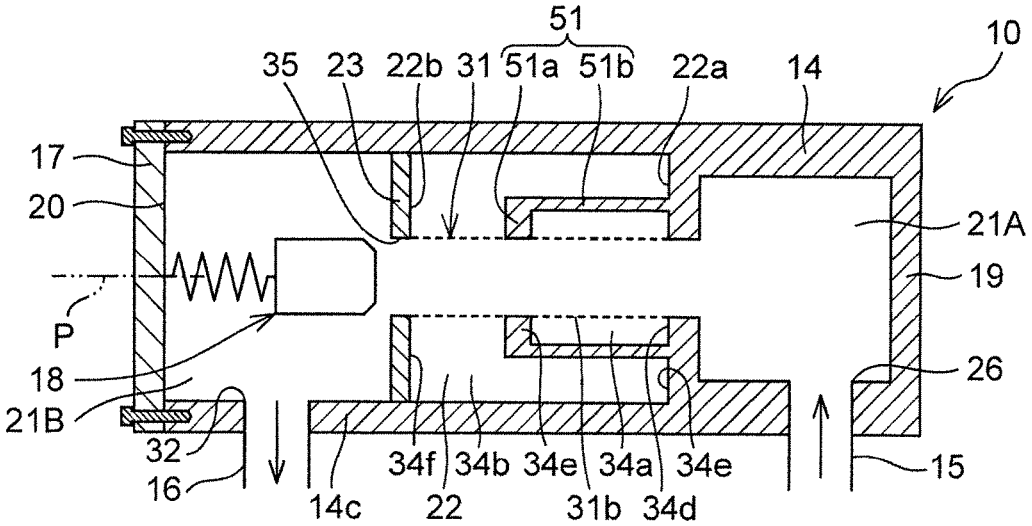
FIG. 23 is a schematic longitudinal-sectional view of a silencer in accordance with a seventeenth embodiment of the present invention.

FIG. 23 illustrates a seventeenth embodiment of the present invention. As in the sixteenth embodiment, in a silencer body 14, a low frequency-side attenuating portion 21A, a high frequency-side attenuating portion 22 (adjacent attenuating portion), and a low frequency-side attenuating portion 21B are provided in this order from the upstream side (on the side of a closed section 19) toward the downstream side (on the side of an opening 20). The high frequency-side attenuating portion 22 is provided with a perforated plate 31 and a second partition 51. The second partition 51 includes a first portion 51*a* and a second portion 51*b*, and the second partition 51, and a side wall 14*c* of the silencer body 14 constitute a first region 34*a* and a second region 34*b* in a nested configuration.

A draw-in portion 15 is disposed in a portion of the silencer body 14 other than an axial end of the most upstream low frequency-side attenuating portion 21A, that is, on a side wall 14*c* of the silencer body 14. The high frequency-side attenuating portion 22 is adjacently disposed downstream of the low frequency-side attenuating portion 21A. For this reason, nonlinearity of the perforated plate 31 with respect to sound pressure can be effectively used to achieve a higher silencing effect. Sound waves enter into the high frequency-side attenuating portion 22 immediately after bending or disturbing occurs in the travelling direction, enhancing the attenuating effect in the high frequency-side attenuating portion 22 more effectively.

The other configuration and effects of the seventeenth embodiment is the same as those in the thirteenth embodiment.

Eighteenth Embodiment

Figure 24:
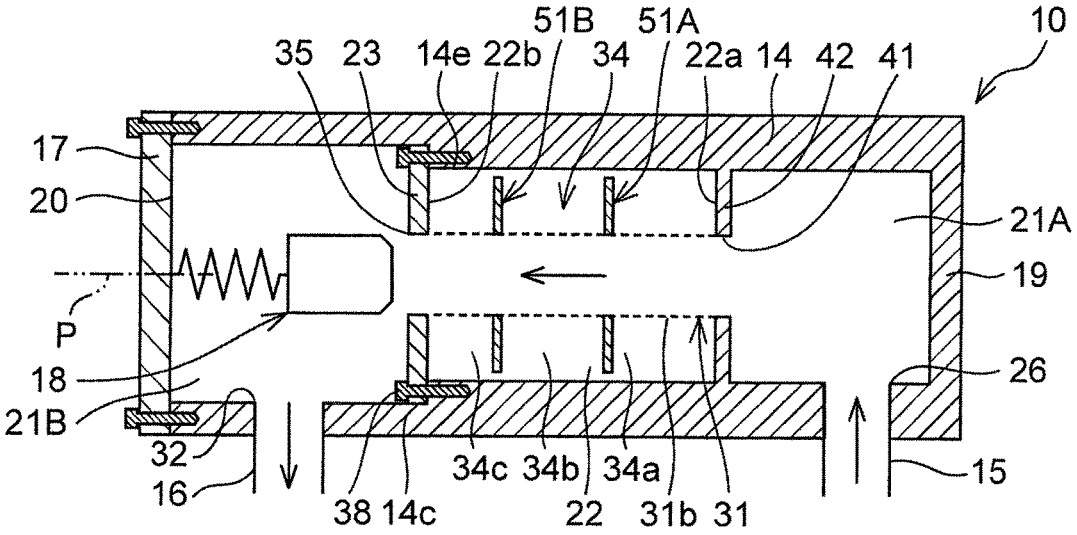
FIG. 24 is a schematic longitudinal-sectional view of a silencer in accordance with an eighteenth embodiment of the present invention.
Figure 25:
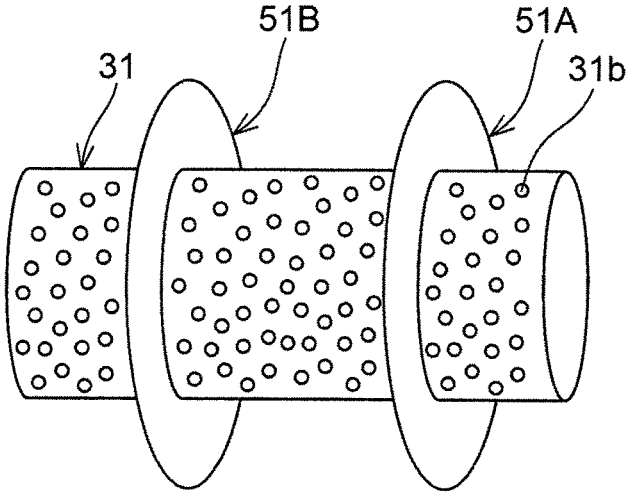
FIG. 25 is a schematic perspective view of a core body-type perforated plate.

FIG. 24 and FIG. 25 illustrate an eighteenth embodiment of the present invention. In a silencer body 14, a low frequency-side attenuating portion 21A, a high frequency-side attenuating portion (adjacent attenuating portion) 22, and a low frequency-side attenuating portion 21B are provided in this order from the upstream side (on the side of the closed section 19) toward the downstream side (on the side of the opening 20). The high frequency-side attenuating portion 22 accommodates a perforated plate 31 provided with two second partitions 51A, 51B. The two second partitions 51A, 51B partition a rear air layer 34 into three regions: a first region 34*a*, a second region 34*b*, and a third region 34*c*.

The other configuration and effects of the eighteenth embodiment is the same as those in the thirteenth embodiment.

(Nineteenth embodiment)

Figure 26:
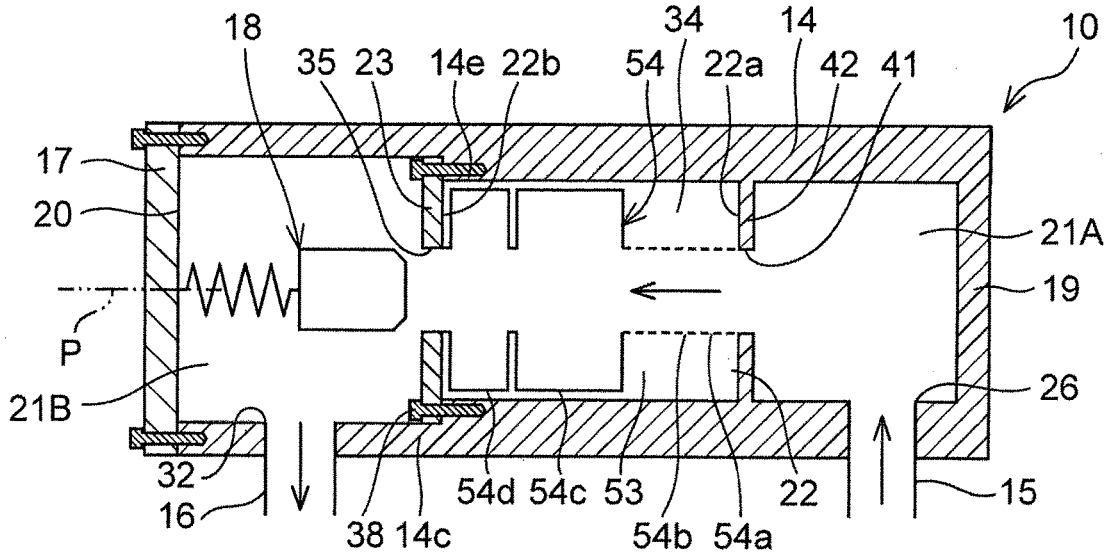
FIG. 26 is a schematic longitudinal-sectional view of a silencer in accordance with a nineteenth embodiment of the present invention.
Figure 27:
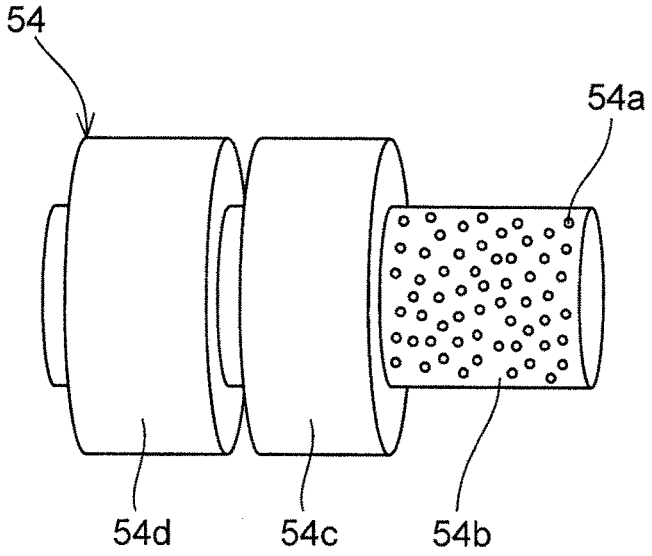
FIG. 27 is a schematic perspective view of a core body.

FIG. 26 and FIG. 27 illustrate a nineteenth embodiment of the present invention. In a silencer body 14, a low frequency-side attenuating portion 21A, an attenuating portion 53 (adjacent attenuating portion), and a low frequency-side attenuating portion 21B are provided in this order from the upstream side (on the side of a closed section 19) toward the downstream side (on the side of an opening 20).

The attenuating portion 53 accommodates a core 54. The core 54 includes a tubular perforated plate 54*b* having through holes 54*a*, a first extended chamber 54*c* that is located downstream of the perforated plate 54*b* and has no hole, and a second extended chamber 54*d* that is located downstream of the first extended chamber 54*c* and has no hole. The core 54 thus configured can be manufactured by electromagnetic shaping or press working of a metal thin plate. Although the core 54 is cylindrical in the present embodiment, the core 54 may have any shape such as polygonal column.

The silencer of the present invention is not limited to the embodiments, and may be variously modified as follows.

Figure 28:
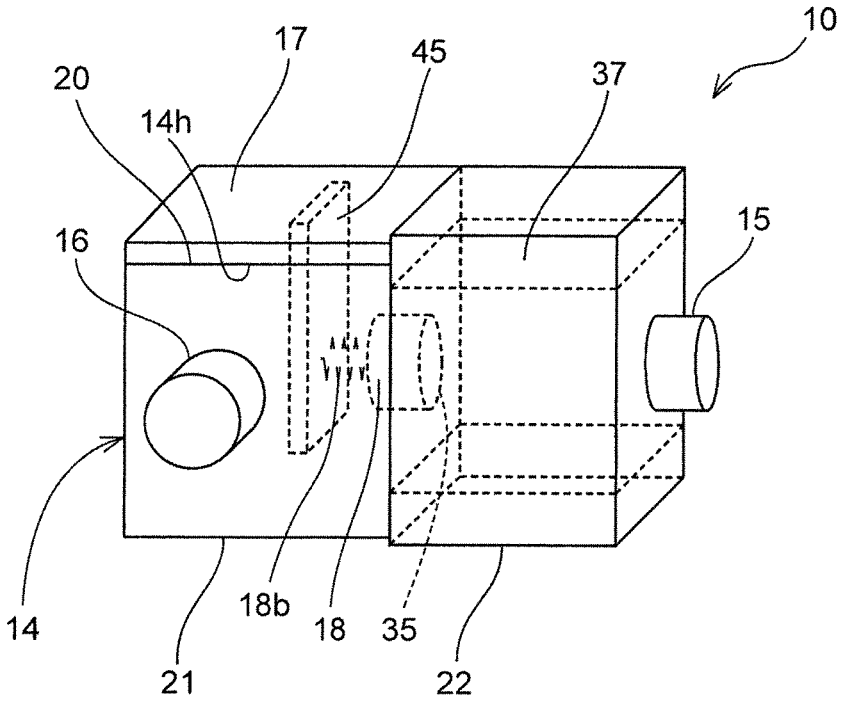
FIG. 28 is a perspective view of a modification of the present invention.

As illustrated in FIG. 28, the silencer body 14 may be shaped as a rectangular parallelepiped (rectangular column). An opening 20 may be formed in a top wall 14*h* of the silencer body 14 that defines the attenuating portion 21 on the most downstream side. The valve portion 18 may be provided at the cover portion 17 via a vertically-extending fixing portion 45. The opening 20 may be formed in another wall of the silencer body 14 that defines the attenuating portion 21 on the most downstream side, on which the draw-out portion 16 is provided.

The silencer body 14 that defines the low frequency-side attenuating portion 21 and the high frequency-side attenuating portion 22 may be shaped as any polygonal column other than rectangular column, or a combination of polygonal column and circular column.

The silencer 10 may include same type of attenuating portions, or include three or more types of attenuating portions. With this configuration, an excellent silencing effect can be achieved in a certain frequency range or a wide frequency range.

The thickness and material of the sound absorbing member 37 may be selected according to gas to be passed. The sound absorbing member 37 may be adhered to the inner side of the silencer body 14, or may be wound around a frame such as punch metal. When used under higher temperatures, the sound absorbing member 37 may be made of a metal fiber material such as iron and stainless steel.

When the perforated plate 31 and the rear air layer 34 constitute the high frequency-side attenuating portion 22, to acquire various frequency characteristics, the opening ratio of the perforated plate 31 and the capacity of the rear air layer 34 can be properly designed. The perforated plate 31 may be a metal plate made of iron, aluminum, or the like.

Although the draw-in portion 15 is bent at right angles into an L-shape in the sixth embodiment, the draw-in portion 15 may be bent at any angle other than 90 degrees. The draw-in portion 15 may have a relatively large curvature.

The bent draw-in portion 15 may be connected to the discharge port 27 of the compressor body 11, such that the most upstream high frequency-side attenuating portion 22 is invisible from the discharge port 27 of the compressor body 11. Thereby, a substance dropped from the sound absorbing member 37 can be prevented from entering from the most upstream high frequency-side attenuating portion 22 into the compressor body 11 through the discharge port 27 of the compressor body 11. When the sound absorbing member 37 constitute a sound absorbing chamber that is the high frequency-side attenuating portion 22, a fiber of the sound absorbing member 37 may drop off. When the fiber mixes in the compressor body, for example, the fiber may be caught in a tooth of the screw, leading to a mechanical failure. Such failure can be avoided by disposing the high frequency-side attenuating portion 22 so as to be invisible from the discharge port 27 of the compressor body 11.

In the eighth embodiment, the bypass pipe 43 may be provided outside the shortest route from the inflow port 26 to the intermediate communicating portion 41. The bypass pipe 43 may extend in any direction. To readily check opening/closing of the valve portion 18, desirably, the bypass pipe 43 is not coaxial with the axis P. Since the bypass pipe 43 is a path in which fluid flows only during unloading having a lower flow rate than loading of the screw compressor, the path sectional area of the bypass pipe 43 may be smaller than the sectional area of the draw-in portion 15 of the silencer 10.

The silencer 10 may be incorporated into equipment other than compressors, for example, automobiles, railcars, ships that have an engine.

EXAMPLES

Figure 29:
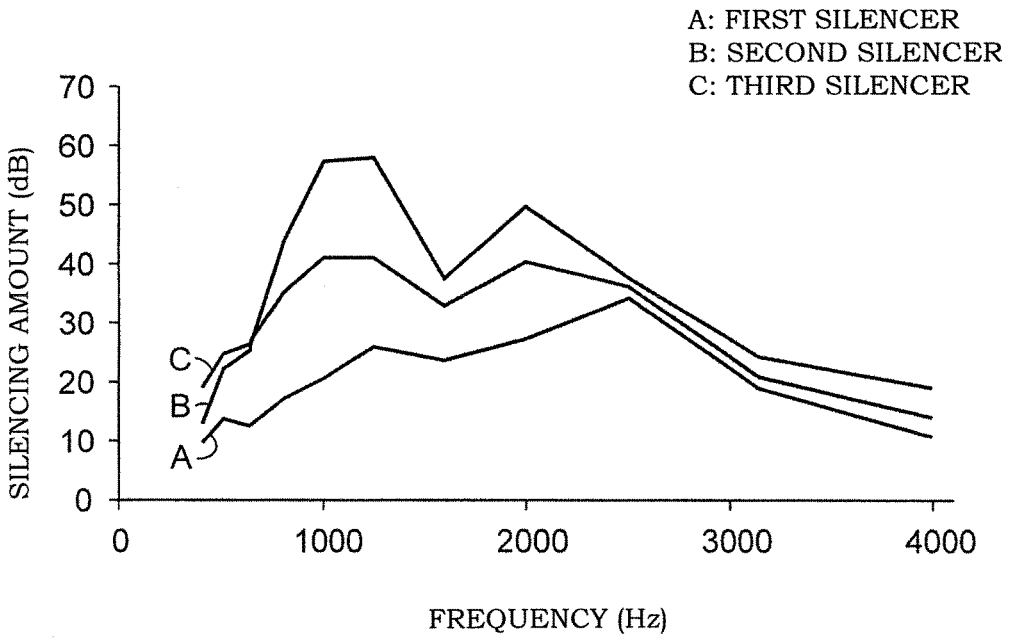
FIG. 29 is a graph illustrating numerical analysis results of the silencing effect of silencers.

FIG. 29 illustrates numerical analysis results of the silencing effect of the silencer incorporated into an oil-free compressor on a discharge side. Under setting conditions, pressure pulsation frequency at its rating operation is about 900 Hz. However, since the number of revolutions of the compressor changes according to needs of discharged air, analysis was made in the range of 400 to 4,000 Hz.

Following first to third silencers were analyzed. These silencers have respective silencer bodies of the same type.

First silencer: A conventional silencer including a single attenuating portion designed to have a sound absorbing member to exert the silencing effect in a wide frequency range (illustrated in FIG. 1 of JP 09-170554 A)

Second silencer: A silencer in a comparison example (FIG. 31) (the draw-in portion 15 of the silencer 10 in the seventh embodiment (FIG. 8) is installed at an end along the axis P)

Third silencer: The silencer 10 in the seventh embodiment (FIG. 8)

As illustrated in FIG. 29, in the first silencer, the frequency having a high silencing effect was 2,500 Hz, and the silencing amount at 2,500 Hz was about 30 dB. The silencing amount at 800 Hz or less was 20 dB or less.

In the third silencer, the silencing amount at frequencies of 500 Hz or more was 20 dB or more. In the whole analyzed frequency range, the third silencer had a much higher silencing effect than the first silencer. In the third silencer, the path was bent twice in total: from the draw-in portion 15 to the intermediate communicating portion 41, and from the intermediate communicating portion 35 to the draw-out portion 16.

On the contrary, in the second silencer, the path was bent only once from the intermediate communicating portion 35 to the draw-out portion 16. The second silencer and the third silencer each including three attenuating portions have a higher silencing effect than the first silencer including only one attenuating portion. When comparing the second silencer including the path bent once with the third silencer bent twice, it was confirmed that the third silencer had a higher silencing effect.

Figure 30:
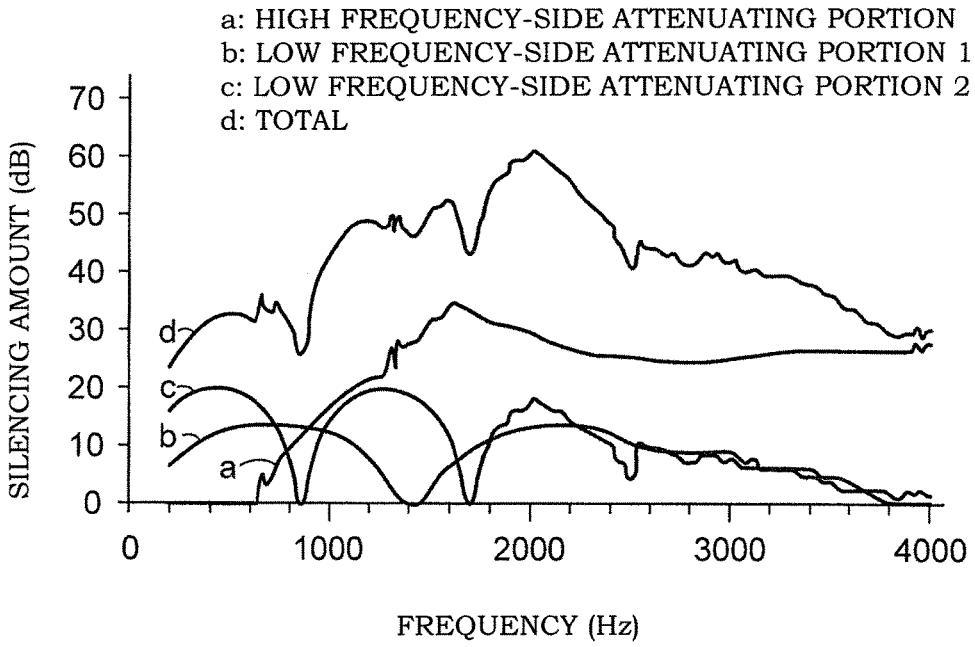
FIG. 30 is a graph illustrating contribution of each attenuating portion of the present invention and the silencing amount of the silencer as a whole.

FIG. 30 illustrates contribution of each attenuating portion of the present invention, and the silencing amount of the silencer as a whole. In a low frequency-side attenuating portion 2 (the low frequency-side attenuating portion 21B in FIG. 31), it was confirmed that the silencing amount lowered at certain frequencies (840 Hz, 1,700 Hz) lowered due to relationship between path length and frequency, and was decreasing in a high frequency range. In a low frequency-side attenuating portion 1 (for example, the low frequency-side attenuating portion 21A in FIG. 31), the almost similar tendency was observed.

Figure 31:
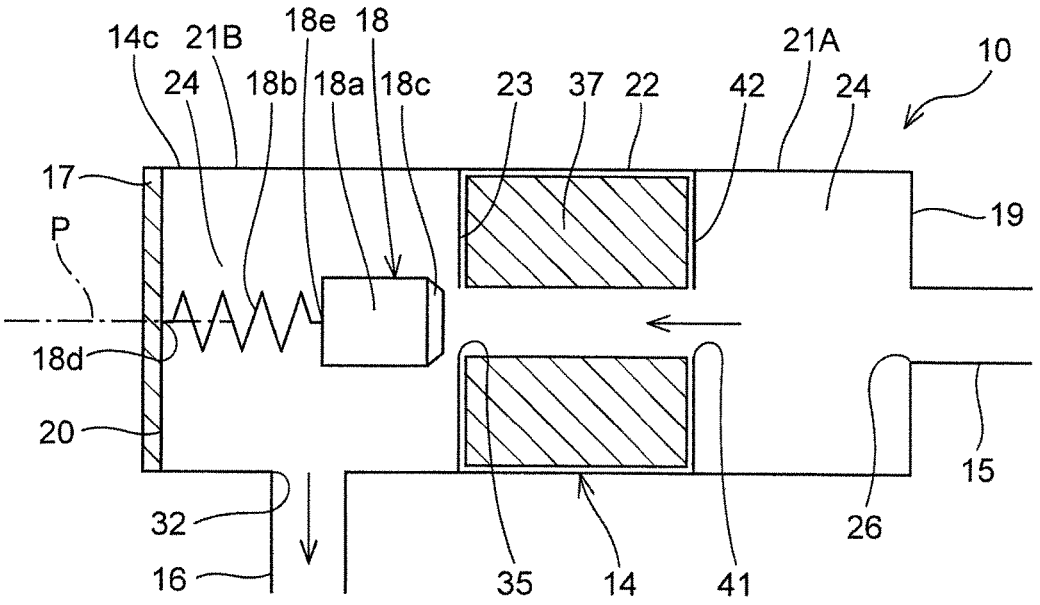
FIG. 31 is a schematic longitudinal-sectional view of a silencer in a comparison example for analysis on the silencing effect.

Meanwhile, in a high frequency-side attenuating portion (for example, the high frequency-side attenuating portion 22 in FIG. 31), it was confirmed that the silencing amount was large in a high frequency range, and small in a low frequency range. Therefore, a silencer capable of achieving the silencing effect in a wide frequency range can be realized by suitably combining the plurality of characteristics. The silencing amount in the low frequency-side attenuating portion is larger as a change in the path sectional area is larger, and the silencing amount in the high frequency-side attenuating portion is larger as the path is longer. A silencer is designed in consideration of this fact. The high frequency-side attenuating portion can function as the low frequency-side attenuating portion according to design conditions.

The invention claimed is:

1. A silencer comprising:

a housing including a draw-in portion drawing in fluid, and a plurality of sound attenuating portions arranged in a flowing direction of the fluid;

a first partition provided with an intermediate communicating portion communicating a most downstream attenuating portion with an adjacent attenuating portion located adjacent to the most downstream attenuating portion;

a valve portion disposed in the most downstream attenuating portion, the valve portion being capable of closing the intermediate communicating portion;

a valve holding portion holding the valve portion, the valve holding portion being detachably attached to the housing;

a draw-out portion provided in a portion of the most downstream attenuating portion other than the valve holding portion, the draw-out portion drawing out the fluid from the most downstream attenuating portion; and a biasing member elastically biasing the valve portion so as to close the intermediate communicating portion, wherein, in a space formed between the valve portion and the first partition, followed by pressing of flow of the fluid onto the valve portion, a virtual extended area that is an area of a region acquired by extending an inner circumferential face of the intermediate communicating portion to an end face of the valve portion on the side of the first partition is larger than a path sectional area of the draw-in portion.

2. The silencer according to claim 1, wherein a path sectional area of the most downstream attenuating portion, and a path sectional area of the adjacent attenuating portion each are larger than a path sectional area of the intermediate communicating portion.

3. The silencer according to claim 1, wherein the plurality of attenuating portions includes a low frequency-side attenuating portion attenuating sound in a lower frequency range, and a high frequency-side attenuating portion attenuating sound in a higher frequency range.

4. The silencer according to claim 3, wherein the adjacent attenuating portion is the high frequency-side attenuating portion in which a sound absorbing member is disposed, and wherein the first partition is detachably attached to the housing.

5. The silencer according to claim 3, wherein the adjacent attenuating portion is the high frequency-side attenuating portion, and wherein the draw-in portion has a bent configuration.

6. The silencer according to claim 4, wherein the draw-in portion is connected to a discharge port of a compressor body, and wherein the most upstream attenuating portion is disposed so as to be invisible from the discharge port of the compressor body.

7. The silencer according to claim 3, wherein the most upstream attenuating portion is the low frequency-side attenuating portion, and wherein the draw-in portion is disposed on a side wall of the housing defining the most upstream attenuating portion.

8. The silencer according to claim 7, wherein the most upstream attenuating portion is provided with a bypass pipe.

9. The silencer according to claim 3, wherein the high frequency-side attenuating portion includes:

a tubular perforated plate having a plurality of through holes;

a rear fluid layer provided between the perforated plate and the housing; and a second partition partitioning the rear fluid layer into a first region and a second region arranged in a flowing direction of the fluid in the perforated plate.

10. The silencer according to claim 9, wherein a gap is provided between the second partition and a side wall of the housing or the perforated plate.

11. The silencer according to claim 9, wherein the first region and the second region have different effective thicknesses defined as a ratio of a volume of the rear fluid layer to a porous area that is a sum of areas of the through holes.

12. The silencer according to claim 11, wherein the second partition partitions the rear fluid layer such that the first region and the second region partially overlap each other.

13. The silencer according to claim 9, wherein the most upstream attenuating portion is the low frequency-side attenuating portion, wherein the high frequency-side attenuating portion is adjacently provided downstream of the low frequency-side attenuating portion, and wherein the draw-in portion has a bent configuration.

14. The silencer according to claim 9, wherein the most upstream attenuating portion is the low frequency-side attenuating portion, wherein the high frequency-side attenuating portion is adjacently provided downstream of the low frequency-side attenuating portion, and wherein a direction in which the fluid is introduced into the low frequency-side attenuating portion in the draw-in portion is different from a direction in which the fluid flows from the low frequency-side attenuating portion to the high frequency-side attenuating portion.

15. The silencer according to claim 3, wherein the attenuating portion adjacently disposed upstream or downstream of the high frequency-side attenuating portion has a length that is a half of a length of the rear fluid layer.

16. The silencer according to claim 15, wherein the attenuating portion having the length that is a half of the length of the rear fluid layer is adjacently provided upstream of the high frequency-side attenuating portion.

* * * * *